US006287514B1

(12) United States Patent
Mizushima et al.

(10) Patent No.: US 6,287,514 B1
(45) Date of Patent: Sep. 11, 2001

(54) SINTER AND CASTING COMPRISING FE-BASED HIGH-HARDNESS GLASSY ALLOY

(75) Inventors: Takao Mizushima; Akihiro Makino, both of Niigata-ken; Akihisa Inoue, Miyagi-ken, all of (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/408,765

(22) Filed: Sep. 29, 1999

Related U.S. Application Data

(62) Division of application No. 09/140,806, filed on Aug. 26, 1998, now Pat. No. 6,086,651.

(30) Foreign Application Priority Data

Aug. 28, 1997 (JP) ..... 9-233069
Aug. 29, 1997 (JP) ..... 9-249932

(51) Int. Cl.[7] ..... C22C 1/04; C22C 1/10; C22C 33/00

(52) U.S. Cl. ..... 420/121; 148/330; 75/231; 75/244; 75/246

(58) Field of Search ..... 148/403, 330; 420/121; 75/231, 244, 246

(56) References Cited

U.S. PATENT DOCUMENTS

| | | |
|---|---|---|
| 4,529,458 | 7/1985 | Kushnick et al. . |
| 4,594,104 | 6/1986 | Reybould . |
| 4,613,371 | 9/1986 | Cheney et al. . |
| 5,261,664 | 11/1993 | Anderson . |
| 5,738,733 | 4/1998 | Inoue . |
| 5,876,519 | 3/1999 | Inoue et al. . |
| 6,086,651 | 7/2000 | Mizushima et al. . |

FOREIGN PATENT DOCUMENTS

| | | |
|---|---|---|
| 56-75542 | 6/1981 | (JP) . |
| 57-202709 | 6/1981 | (JP) . |

*Primary Examiner*—Daniel J. Jenkins
(74) *Attorney, Agent, or Firm*—Brinks Hofer Gilson & Lione

(57) ABSTRACT

The present invention relates to a sinter and a casting comprising a high-hardness glassy alloy containing at least Fe and at least a metalloid element and having a temperature interval ΔTx of a supercooled liquid as expressed by ΔTx= Tx−Tg (where, Tx is a crystallization temperature and Tg is a glass transition temperature) of at least 20° C., which permit easy achievement of a complicated concave/convex shape.

12 Claims, 19 Drawing Sheets

SINTER AND CASTING COMPRISING FE-BASED HIGH-HARDNESS GLASSY ALLOY

This application is a divisional of U.S. patent application Ser. No. 09/140,806 field Aug. 26, 1998 now U.S. Pat. No. 6,086,651.

BACKGROUND OF THE INVENTION

1. Field of the invention

The present invention relates to a sinter and a casting applicable to a part having fine surface irregularities such as a gear, a milling head, a golf club head or a golf club shaft. More particularly, the invention relates to a sinter or a casting comprising a glassy alloy capable of being formed into a non-crystalline bulk-shaped product having a high hardness.

2. Description of the Related Art

Some kinds of multi-element alloy have a property of not crystallizing when a composition is quenched from a molten state, and transferring to a vitreous solid via a supercooled liquid state having a certain temperature range. A non-crystalline alloy falling under this category is known as a glassy alloy. Conventionally known amorphous alloys include an Fe—P—C-system non-crystalline alloy manufactured for the first time in the 1960s, an (Fe, Co, Ni)—P—B-system and an (Fe, Co, Ni)—Si—B-system non-crystalline alloys manufactured in the 1970s, and an (Fe, Co, Ni)—M(Zr, Hf, Nb)-system non-crystalline alloy and an (Fe, Co, Ni)—M(Zr, Hf, Nb)—B-system non-crystalline alloy manufactured in the 1980s. These alloys, having magnetism, were expected to be applied as non-crystalline magnetic materials.

Since any of the conventional amorphous alloys has a tight temperature range in the supercooled liquid state, a non-crystalline product cannot be formed unless it is quenched at a high cooling rate on a level of $10^{5°}$ C./s by the application of a method known as the single roll process. The product manufactured by quenching by the single roll process took a shape of a thin strip having a thickness of up to about 50 $\mu$m, and a bulk-shaped non-crystalline solid was unavailable. When a bulk-shaped formed product is to be obtained from this thin strip, a sinter is obtained by crushing the thin strip resulting from the application of the liquid quenching process, and sintering the crushed strip under pressure in a sealed space. The sinter produced from the conventional amorphous alloy is porous and brittle, and is not applicable as a part subjected to stress such as a gear, a milling head, a golf club head or a golf club shaft.

Glassy alloys known as having a relatively wide temperature range in the supercooled liquid state, and giving a non-crystalline solid through slower cooling include Ln—Al—TM, Mg—Ln—TM, ZR—Ln—TM (where, Ln is a rare-earth element, and TM is a transition metal)-based alloys developed during the period of 1988 through 1991. Non-crystalline solids having a thickness of several mm available from these glassy alloys have special compositions in all cases and contain rare-earth elements, resulting in a high cost, and no sufficient study is made regarding applications.

The head portion of a wood-type golf club is usually manufactured with a metal such as stainless steel, an aluminum alloy or a titanium alloy as a material, and the resultant metal wood forms the main current in the market. As compared with the conventional persimmon wood, the metal would provide an advantage of a very high degree of freedom in designing the head.

In an iton-type golf club also iron (soft iron), stainless steel, carbon, titanium alloy and various other materials are used for the head.

In a putter-type golf club as well, iron (soft iron), stainless steel, titanium alloy, duralumin and various other materials are applicable.

For the shaft for a golf club, the carbon shaft excellent in lightness and easiness to handle forms the main current in place of the conventional steel shaft. The carbon shaft have advantage of a high degree of freedom in design, and various kinds of shaft are now commercially available, including those for frail women and for professional golfers.

For a wood-type golf club having a head made of stainless steel, it is believed that only a head having a relatively large thickness and a small volume (up to about 220 cc) is manufacturable because of a strength not so-high of the material and a high specific gravity.

An aluminum alloy used for a golf clubhead is generally believed manufacturable into a large head because of a high specific gravity, but inferior to a stainless steel or titanium alloy head in yardage.

A titanium alloy, which is suitable as a material for a golf club because of a high strength and an excellent repellent force, must be fabricated in a vacuum or in an inert gas and the yield is low, resulting in a very high unit cost of a head.

For the iron-type golf club, the head made of soft iron has defects of a relatively large specific gravity and easy susceptibility to flaws.

A stainless steel head, which is excellent in durability, does not permit adjustment if the lie angle or the loft angle, and is kept at arm's length by senior golfers.

A head made of a titanium alloy is defective in that fabrication requires much time and labor, leading to a very high unit cost as described above.

As compared with the above-mentioned metal heads, a carbon head is far more susceptible to flaws and handling must be careful.

A putter-type golf club should preferably be provided simultaneously with appropriate bounce and weight, but a material satisfying these requirements has not as yet been existent.

A carbon shaft for a golf club has generally a configuration in which it comprises an inner layer obtained by aligning carbon fiber groups in a direction, impregnating the same with a thermosetting synthetic resin and forming the same into a tubular shape, and an outer layer available by aligning fine line or filament-shaped alloy groups in a direction, impregnating the same with a thermosetting synthetic resin, and forming the same. The alloy used for the outer layer has an important effect on properties of the carbon shaft. In order to manufacture a shaft light in weight, it is necessary to make the alloy of the outer layer finer, but this results in a lower strength. In order to increase strength, it suffices to use larger alloy lines, but this leads to a larger weight.

SUMMARY OF THE INVENTION

During search for a high-hardness material having excellent properties as parts having surface fine irregularities such as a gear, a milling head, a golf clubhead and a golf club shaft, the present inventors found that a certain glassy alloy had a relatively wide temperature range in the supercooled state, was capable of being manufactured into a bulk-shaped non-crystalline solid product, and gave a very high-hardness non-crystalline solid product. Further, possibility was found to manufacture a high-hardness parts having fine surface irregularities by sintering powder of this glassy alloy at a sintering temperature near the crystallization temperature or casting the same in a mold, thus arriving at development of the present invention. The present invention was developed in view of the above-mentioned circumstances, and has an object to provide a high-hardness sinter or casting having fine surface irregularities manufactured from a glassy alloy permitting formation of a high-hardness bulk-shaped non-crystalline form.

The sinter or casting of the present invention comprises a high-hardness glassy alloy containing at least Fe and at least a metalloid element and having a temperature interval ΔTx=Tx−Tg (where, Tx is a crystallization temperature and Tg is a glass transition temperature) of at least 20° C.

The glassy alloy (metal-metalloid-based glassy alloy) has a value of ΔTx of at least 35° C. and contains Fe as a metal element. The above-mentioned metal-metalloid-based glassy alloy contains at least one metal element selected from the group consisting of Al, Ga, In and Sn, and at least one metalloid element selected from the group consisting of P, C, B, Ge and Si.

In the present invention, the metal-metalloid-based glassy alloy has a composition in atomic %: from 1 to 10% Al, from 0.5 to 4% Ga, from 0 to 15% P, from 2 to 7% C, from 2 to 10% B, and the balance Fe. Or, the above-mentioned metal-metalloid-based glassy alloy has a composition in at once %: from 1 to 10% Al, from 0.5 to 4% Ga, from 0 to 15% P, from 2 to 7% C, from 2 to 10% B, from 0 to 15% Si, and the balance Fe.

The glassy alloy used in the invention (metal-metal glassy alloy) mainly comprises at least one element selected from the group consisting of Fe, Co and Ni, contains at least one selected from the group consisting of Zr, Nb,Ta, Hf, Mo, Ti and V, and has a value of ΔTx of at least 20° C.

In the invention, the above-mentioned metal-metal glassy alloy has a value of ΔTx of at least 60° C., and is expressed by the following chemical formula:

$$(Fe_{1-a-b}Co_aNi_b)_{100-x-y}M_xB_y$$

where, $0 \leqq a \leqq 0.29$, $0 \leqq b \leqq 0.43$, 5 atomic $\% \leqq x \leqq 20$ atomic %, 10 atomic $\% \leqq y \leqq 22$ atomic %, and M is at least one element selected from the group consisting of Zr, Nb, Ta, Hf, Mo, Ti and V.

Or, the above-mentioned metal-metal glassy alloy has a value of ΔTx of at least 60° C., and is expressed by the following chemical formula:

$$(Fe_{1-a-b}Co_aNi_b)_{100-x-y-z}M_xB_yT_z$$

where, $0 \leqq a \leqq 0.29$, $0 \leqq b \leqq 0.46$, 5 atomic $\% \leqq x \leqq 20$ atomic %, 10 atomic $\% \leqq y \leqq 22$ atomic %, 0 atomic $\% \leqq z \leqq 5$ atomic %, M is at least one element selected from the group consisting of Zr, Nb, Ta; Hf, Mo, Ti and V, and T is at least one element selected from the group consisting of Cr, W, Ru, Rh, Pd, Os, Ir, Pt, Al, Si, Ge, C and P.

Another metal-metal glassy alloy used in the invention mainly comprises Fe, and contains at least one element R selected from the group consisting of rare-earth elements, at least one element A and/or B selected from the group consisting of Ti, Zr, Hf, V, Nb, Ta, Cr, Mo, W and Cu, and has a value of ΔTx of at least 20° C.

In the invention, the above mentioned metal-metal glassy alloy has a chemical composition as expressed by the following chemical formula:

$$Fe_{100-c-d-f-w}R_cA_dE_fB_w$$

Where, E is at least one element selected from the group consisting of Co and Ni, and component ratios c, d, f and w are in atomic %: 2 atomic $\% \leqq c \leqq 15$ atomic %, 2 atomic $\% \leqq d \leqq 20$ atomic %, 0 atomic $\% \leqq f \leqq 20$ atomic %, and 10 atomic $\% \leqq w \leqq 30$ atomic %.

Or, the above-mentioned other metal-metal glassy alloy may have a chemical composition as expressed by the following chemical formula:

$$Fe_{100-c-d-f-w-t}R_cA_dE_fB_wL_t$$

Where, E is at least one element selected from the group consisting of Co and Ni; component ratios c, d, f, w and t are in atomic %: 2 atomic $\% \leqq c \leqq 15$ atomic %, 2 atomic $\% \leqq d \leqq 20$ atomic %, 0 atomic $\% \leqq f \leqq 20$ atomic %, 10 atomic $\% \leqq w \leqq 30$ atomic %, and 0 atomic $\% \leqq t \leqq 5$ atomic %; and element L is at least one element selected from the group consisting of Ru, Rh, Pd, Os, Ir, Pt, Al, Si, Ge, Ga, Sn, C and P.

The manufacturing method of the invention may comprise the steps of sintering powder of the above-mentioned glassy alloy, or casting from a melt of the above-mentioned glassy alloy, and then, applying a heat treatment to the same so that at least a part thereof is crystallized.

In the invention, a crystalline phase precipitated through a crystallization treatment shall also be called a glassy alloy. An alloy having ΔTx is called a glassy alloy and one not having ΔTx is called an amorphous for discrimination.

DESCRIPTION OF THE PREFERRED EMBODIMENTS

Figure 1:
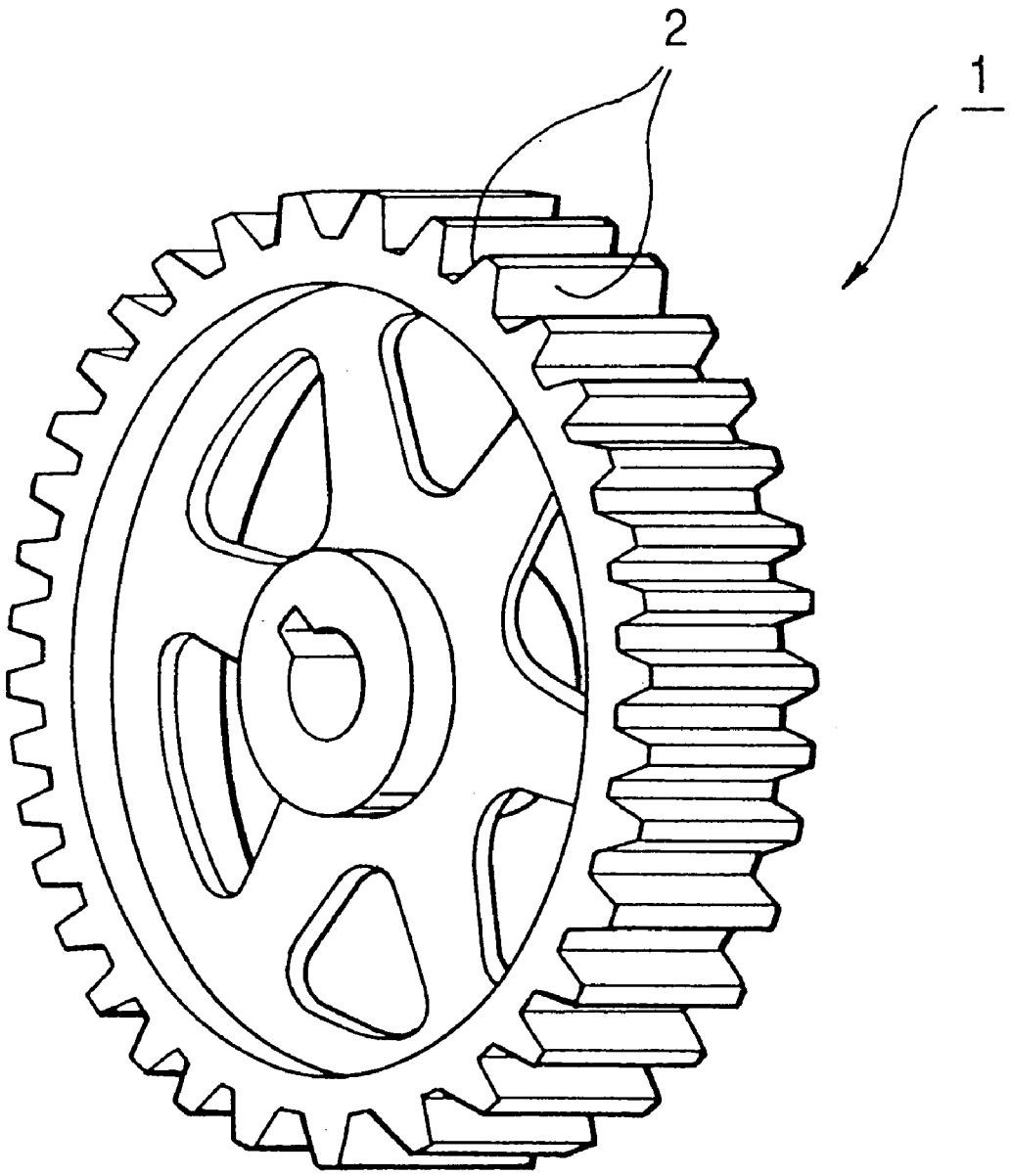
FIG. 1 is a perspective view illustrating an embodiment of the gear of the present invention.

Embodiments of the invention will now be described.

First, the glassy alloy used in the invention will be described.

A glassy alloy having a temperature interval ΔTx of the supercooled liquid as expressed by the formula ΔTx=Tx−Tg (where, Tx is a crystallization temperature, and Tg is the glass transition temperature) is employed in the invention. Applicable glassy alloys include metal-metalloid glassy alloys and metal-metal glassy alloys.

The above-mentioned metal-metalloid glassy alloy has a temperature interval ΔTx of the supercooled liquid of at least 35° C., or in some compositions, a remarkable temperature interval of 40 to 50° C. This has never been foreseen from the Fe-based alloys known from the conventional findings. In addition, while a non-crystalline alloy has so far been achieved only in the form of a thin strip, the present invention gives a bulk-shaped one which is far more excellent in practical merits.

The metal-metalloid glassy alloy used in the invention may have a composition mainly comprising Fe and containing other metals and metalloids. Among others, the other metals can be selected from IIA group. IIIA and IIIB groups, IVA and IVB groups, VA group, VIA group and VIIA group of the periodic table. Particularly IIIB groups and IVB group metal elements are suitably applied, i.e., Al (aluminum), Ga (gallium), In (indium) and Sn (tin).

One or more metal element selected from the groups consisting of Ti, Hf, Cu, Mn, Nb, Mo, Cr, Ni, Co, Ta, W and Zr may be blended into the above-mentioned metal-metalloid glassy alloy. Applicable metalloid elements include P (phosphorus), C (carbon), B (boron), Si (silicon) and Ge (germanium).

More specifically, the composition of the metal-metalloid glassy alloy comprises, in atomic %, from 1 to 10% Al, from 0.4 to 4% Ga, from 0 to 15% P, from 2 to 7% C, from 2 to 10% B, and the balance Fe, and may contain incidental impurities.

By further adding Si, it is possible to improve the temperature interval ΔTx of the supercooled liquid and increase the critical thickness of becoming an amorphous single phase. As a result, it is possible to increase thickness of the metal-metalloid glassy alloy. The Si content should preferably be up to 15% since a higher Si content causes disappearance of ΔTx in the supercooled liquid region.

More specifically, the composition of the metal-metalloid glassy alloy comprises, in atomic %, from 1 to 10% Al, 0.5 to 4% Ga, from 0 to 15% P, from 2 to 7% C, from 2 to 10% B, from 0 to 15% Si and the balance Fe, and may contain incidental impurities.

Further, in order to obtain a larger ΔTx in the supercooled liquid region, the composition should preferably include from 6 to 15% P and from 2 to 7% C, and this gives a value of ΔTx in the supercooled liquid region of at least 35° C.

The above-mentioned composition may further contain Ge within a range of from 0 to 4%, or preferable, from 0.5 to 4%.

The composition may further contain at least one element selected from the group consisting of Nb, Mo, Cr, Hf, W and Zr in an amount of up to 7%, and further, up to 10% Ni, and up to 30% Co.

With any of these compositions, in the invention, there is available a value of temperature interval ΔTx of the supercooled liquid of at least 35° C., or in certain compositions, at least 40 to 50° C.

The above-mentioned metal-metal glassy alloy is achieved with a composition mainly comprising one or more of Fe, Co and Ni, added with one or more selected from the group consisting of Zr, Nb, Ta, Hf, Mo, Ti and V in a prescribed amount.

One of the metal-metal glassy alloy used in the invention can be expressed by the following general formula:

$$(Fe_{1-a-b}Co_aNi_b)_{100-x-b}M_xB_y$$

where, preferably, $0 \leqq a \leqq 0.29$, $0 \leqq b \leqq 0.4$, $3.5 \leqq$ atomic $\% \leqq x \leqq 20$ atomic %, 10 atomic $\% \leqq y \leqq 22$ atomic %, and M is one or more elements selected from the group consisting of Zr, Nb, Ta, Hf, Mo, Ti and V.

In the above-mentioned composition, ΔTx should be at least 20° C.

The composition should contain Zr without fail and should preferably have a value of ΔTx of at least 25° C.

In the composition, ΔTx should more preferably be at least 60° C.

The foregoing composition formula $(Fe_{1-a-b}Co_aNi_b)_{100-x-y}M_xB_y$ should preferably satisfy requirements $0.02 \leqq a \leqq 0.29$ and $0.042 \leqq b \leqq 0.43$.

Another metal-metal glassy alloy used in the invention can expressed by the following general formula:

$$(Fe_{1-a-b}Co_aNi_b)_{100-x-y-z}M_xB_yT_z$$

where, $0 \leqq a \leqq 0.29$, $0 \leqq b \leqq 0.46$, 3.5 atomic % $\leqq x \leqq$ 20 atomic %, 10 atomic % $\leqq y \leqq$ 22 atomic %, and 0 atomic % $\leqq z$ 5 atomic %; M is at least one element selected from the group consisting of Zr, Nb, Ta, Hf, Mo, Ti and V; and T is at least one element selected from the group consisting of Cr, W, Ru, Rh, Pd, Os, Ir, Pt, Al, Si, Ge, C and P.

In the above-mentioned composition formula $(Fe_{1-a-b}Co_aNi_b)_{100-x-y-z}M_xB_yT_z$, the metal-metal glassy alloy used in the invention may satisfy conditions $0.042 \leqq a \leqq 0.29$ and $0.042 \leqq b \leqq 0.43$.

The above-mentioned element M may be expressed by $(M'_{1-h}M''_h)$ where M' is at least one of Zr and Hf; M" is one or more selected from the group consisting of Nb, Ta, Mo, Ti and V and satisfy $0 \leqq h \leqq 0.6$.

Further, the foregoing composition may include h within a range $0.2 \leqq h \leqq 0.4$, or $0 \leqq h \leqq 0.2$.

In the present invention, the composition ratios a and b may be within ranges $0.042 \leqq a \leqq 0.25$ and $0.042 \leqq b \leqq 0.1$.

In the above-mentioned composition, the atom B in an amount of up to 50% may be substituted with C.

Reasons of Limiting Composition

In the metal-metal glassy alloy used in the invention, a value of ΔTx of at least 60° C. is available by selecting appropriate contents of Co and Ni in a composition mainly comprising Fe. More specifically, in order to certainly achieve a value of ΔTx within a range of from 50 to 60° C., it is desirable to select a Co component ratio a of $0 \leqq a \leqq 0.29$, and an Ni component ratio b of $0 \leqq b \leqq 0.43$. In order to certainly obtain a value of ΔTx of at least 60° C., it is desirable to select a Co component ratio a of $0.042 \leqq a \leqq 0.29$, and an Ni component ratio b of $0.042 \leqq b \leqq 0.43$.

M is one or more elements selected from the group consisting of Zr, Nb, Ta, Hf, Mo, Ti and V. These elements are effective for generating an amorphous substance, and should preferably be present in an amount of at least 5 atomic % and up to 20 atomic %. Among other elements M, Zr and Hf are particularly effective. Zr or Hf can partially be substituted with such elements as Nb. In the case of substitution, a range of component ratio h of $0 \leqq h \leqq 0.6$ gives a high value of ΔTx, and in order to obtain a value of ΔTx of at least 80° C., h should preferably be within a range of $0.2 \leqq h \leqq 0.4$.

B has a high amorphous forming ability, and in the invention, is added in an amount within a range of from 10 atomic % to 22 atomic %. Outside this range, i.e., an amount under 10 atomic % is not desirable because of disappearance of ΔTx, and an amount over 22 atomic % makes it impossible to form an amorphous phase.

Further, one or more elements selected from the group consisting of Cr, W, Ru, Rh, Pd, Os, Ir, Pt, Al, Si, Ge, C and P, expressed as T, may be added to the above-mentioned composition.

In the invention, these elements can be added in an amount within a range of from 0 to 5 atomic %.

These elements are added mainly for the purpose of improving corrosion resistance, and an amount outside this range is not desirable because of deterioration of amorphous forming ability.

Another metal-metal-glassy alloy has a composition mainly comprising Fe and added with one or more elements selected from the group consisting of rare-earth elements, one or more elements selected from the group consisting of Ti, Zr, Hf, Nb, Ta, Cr, Mo, W and cu, and B in appropriate amounts.

Further, in the above-mentioned composition, ΔTx should be at least 20° C. In the composition, when containing Cr without fail, ΔTx should preferably be at least 40° C.

A metal-metal glassy alloy used in the invention is expressed by the following composition formula:

$$Fe_{100-c-d-f-w}R_cA_dE_fB_w$$

Where, E is at least one element selected from Co and Ni, and the component ratios c, d, f and w should preferably satisfy requirements 2 atomic % $\leqq c \leqq$ 15 atomic %, 2 atomic % $\leqq d \leqq$ 20 atomic %, 0 atomic % $\leqq f \leqq$ 20 atomic %, and 10 atomic % $\leqq w \leqq$ 30 atomic %.

Another metal-metal glassy alloy used in the invention is expressed by the following composition formula:

$$Fe_{100-c-d-f-w-t}R_cA_dE_fB_wL_t$$

Where, e is at least one element selected from Co and N; the component ratios c, d, f, w and t satisfy requirements 2 atomic % $\leqq c \leqq$ 15 atomic %, 2 atomic % $\leqq d \leqq$ 20 atomic %, 0 atomic % $\leqq f \leqq$ 20 atomic %, 10 atomic % $\leqq w \leqq$ 30 atomic %, and 0 atomic % $\leqq t \leqq$ 5 atomic %; and the element L is at least one element selected from the group consisting of Ru, Rh, Os, Ir, Pt, Al, Si, Ge, Ga, Sn, C and P.

The metal-metal glassy alloy used in the invention should preferably satisfy, in the above-mentioned composition formula $Fe_{100-c-d-f-w}R_cA_dE_fB_w$ or $Fe_{100-c-d-f-w-t}R_cA_dE_fB_wL_t$, the requirement for the component ratio c, in atomic %, 2 atomic % $\leqq c \leqq$ 12 atomic %, or more preferably, 2 atomic % $\leqq c \leqq$ 8 atomic %. The other metal-metal glassy alloy used in the invention should preferably satisfy, in the above-mentioned composition formula $Fe_{100-c-d-f-w}R_cA_dE_fB_w$ or $Fe_{100-c-d-f-w-t}R_cA_dE_fB_wL_t$, the requirement for the component ratio d, in atomic %, 2 atomic % $\leqq d \leqq$ 15 atomic %, or more preferably, 2 atomic % $\leqq d \leqq$ 6 atomic %.

The further metal-metal-glassy alloy used in the invention should preferably satisfy, in the above-mentioned composition formula $Fe_{100-c-d-f-w}R_cA_dE_fB_w$ or $Fe_{100-c-d-f-w-t}R_cA_dE_fB_wL_t$, the requirement for the component ratio f, in atomic %, 0.1 atomic % $\leqq f \leqq$ 20 atomic %, or more preferably, 2 atomic % $\leqq f \leqq$ 10 atomic %.

Another metal-metal glassy alloy used in the invention may have a composition, in the above-mentioned composition formula $Fe_{100-c-d-f-w}R_cA_dE_fB_w$ or $Fe_{100-c-d-f-w-t}R_cA_dE_fB_wL_t$, in which the element A is expressed by $(Cr_{1-r}A'_r)$ where A' is at least one element selected from the group consisting of Ti, Zr, Hf, V, Nb, Ta, Mo, W and Cu and $0 \leqq r \leqq 1$. In the metal-metal glassy alloy expressed by such a composition formula, the component ratio r should preferably be within a range of $0 \leqq r \leqq 0.5$.

In a further metal-metal-glassy alloy used in the invention, the composition rich in Fe tends to give a larger value of ΔTx: the effect of giving a larger value of ΔTx is available by selecting an appropriate value of Co content in a composition containing much Fe.

More specifically, in order to certainly obtains ΔTx, the value of the element E component ratio f should preferably be within a range of $0 \leqq f \leqq 20$, and in order to certainly obtain a value of ΔTx over 20° C., the value of the element E component ratio f should preferably be within a range of 2 atomic % $\leqq f \leqq$ 10 atomic %.

As required, all or part of Co may be replaced by Ni.

R is at least one element selected from the group consisting of rare-earth metals (Y, La, Ce, Pr, Nd, Gd, Tb, Ho and Ey). These elements should preferably be in an amount within a range of from 2 to 5 atomic %. Addition of R in an amount over 15 atomic % causes ΔTx to disappear, leading to an increase in cost.

A is at least one element selected from the group consisting of Ti, Zr, Hf, V, Nb, Ta, Cr, Mo, W and Cu. These elements are effective for generating a non-crystalline product, and should preferably be in an amount within a range of from 2 to 20 atomic %. Among these elements A, Cr is particularly effective. Cr may partially be substituted with at least one element selected from the group consisting of Ti, Zr, Hf, V, Nb, Ta, Mo, W and Cu. In the case of substitution, a component ratio f within a range of $0 \leqq f \leqq 1$ gives a high value of ΔTx. In order to obtain a particularly high ΔTx without fail, the preferable range should be within $0 \leqq c \leqq 0.5$.

B has a high non-crystalline substance generating ability and is added, in the invention, in an amount within a range of from 10 to 30 atomic %. Addition of B is an amount under 10 atomic % is not desirable because of the disappearance of ΔTx. An amount of addition over 30 atomic % is not desirable because of impossibility to form an amorphous product. In order to obtain a higher non-crystalline substance forming ability, the range of addition should preferably be from 14 to 20 atomic %.

At least one element selected from the group consisting of Ru, Rh, Pd, Os, Ir, Pt, Al, Si, Ge, Ga, Sn, C and P, represented by L, may further be added to the above-mentioned composition.

These elements can be added, in the invention, in an amount within a range of from 0 to 5 atomic %. These elements are added with a view to improving mainly corrosion resistance. Outside this range, there occurs deterioration of glass forming ability.

Embodiments of the present invention of a part having fine surface irregularities will now be described with reference to the drawings.

FIG. 1 is a perspective view illustrating a gear manufactured by a manufacturing method of a part having fine surface irregularities of the invention.

The gear 1 of this embodiment is manufactured by sintering the powder of the above-mentioned glassy alloy. The gear 1 has teeth (fine irregularities) 2 on the outer periphery thereof.

Examples of manufacture of the gear 1 will now be described in detail.

Figure 2:
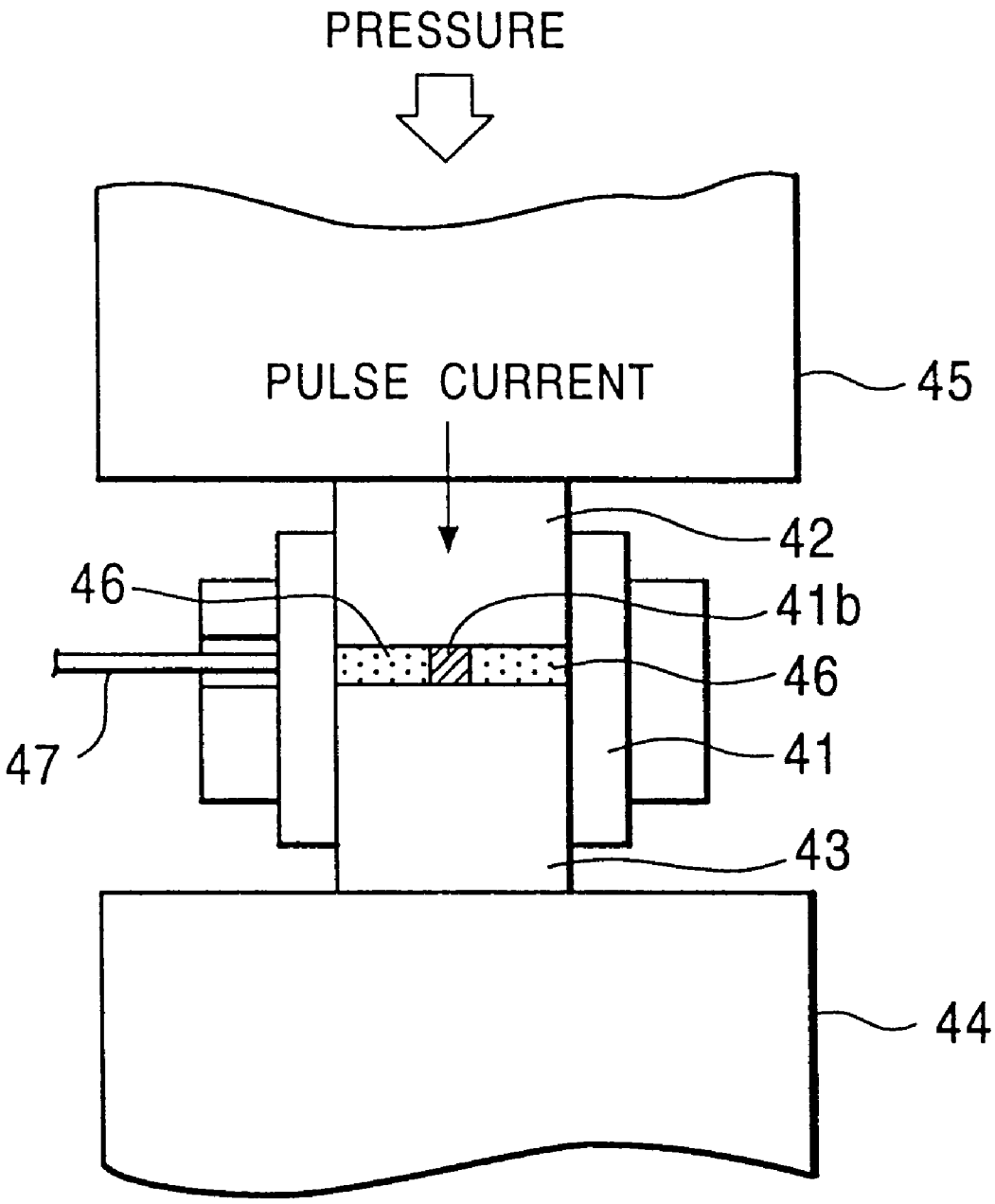
FIG. 2 is a sectional view illustrating the structure of a main part of an embodiment of the spark plasma sintering machine for manufacturing the sinter of the invention.
Figure 3:
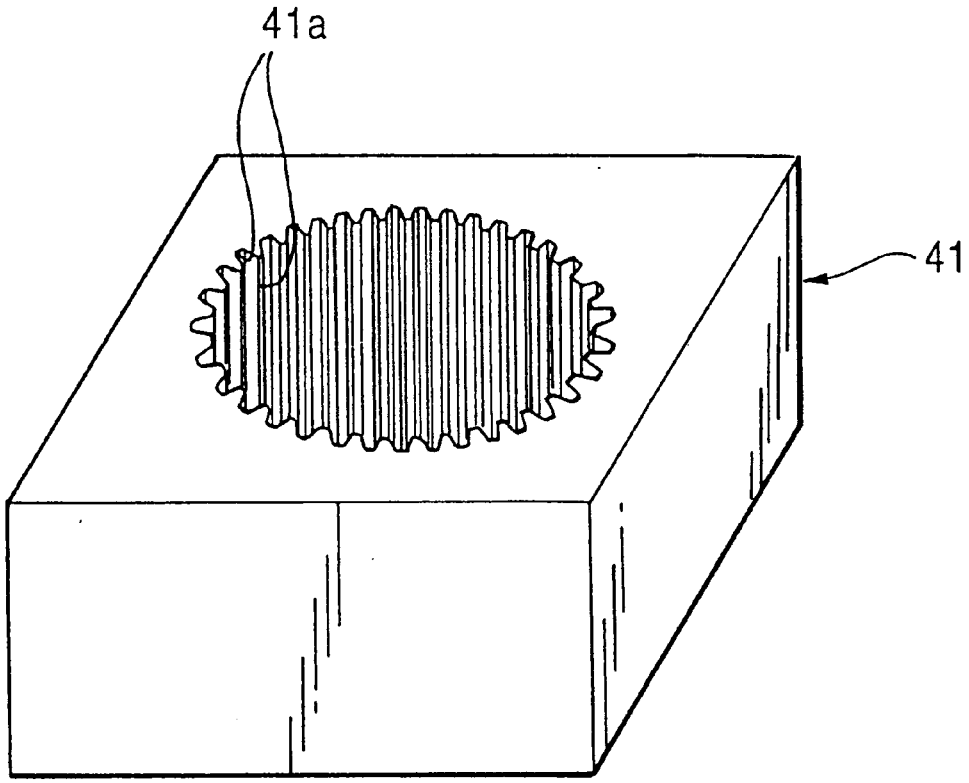
FIG. 3 is a perspective view illustrating a forming mold of the spark plasma sintering machine shown in FIG. 2.

FIG. 2 illustrates main portions of a typical spark plasma sintering machine suitably used for manufacturing the gear 1. The spark plasma sintering machine of this example mainly comprises a cylindrical forming mold 41, an upper punch 42 and a lower punch 43 for pressing a raw material powder (powder particles) charged in this forming mold 41, a punch electrode 44 supporting the lower punch 43 and serving as an electrode on one side when feeding pulse current as described later, another punch electrode 45 pressing down the upper punch 42 and serving as another electrode for feeding pulse current, and a thermocouple 47 for measuring temperature of the powder raw material held between the upper and the lower punches 42 and 43. Fine surface irregularities 41*a* are formed on the inner surface of the forming mold 41 as shown in FIG. 3 in response to the shape of a target form (shape of a gear in this embodiment). A cavity formed by the upper and the lower punches 42 and 43 and the forming mold 41 in the interior of this spark plasma sintering machine has a shape substantially in agreement with the shape of the target formed product (shape of the gear 1 in this embodiment). In FIG. 2, reference numeral 41*b* represents a core rod.

Figure 5:
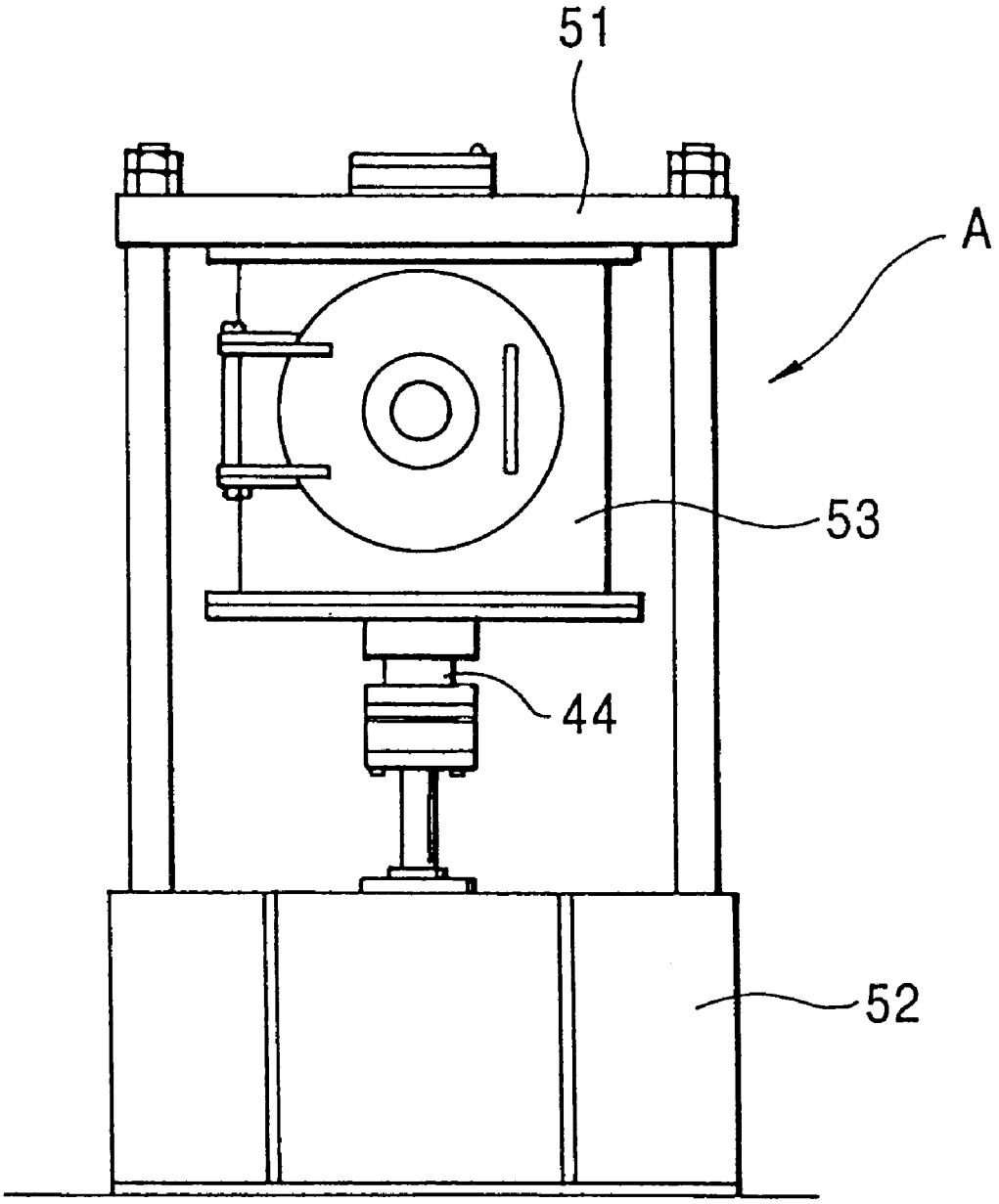
FIG. 5 is a front view illustrating the overall configuration of the example of the spark plasma sintering machine for manufacturing the sinter of the invention.

FIG. 5 illustrates an overall configuration of the above-mentioned spark plasma sintering machine. The spark plasma sintering machine A is a kind of spark plasma sintering machine called Model SPS-2050 manufactured by Sumitomo Cool Mining Co., Ltd., and has the main portions of which the structure is shown in FIG. 2.

The machine shown in FIG. 5 has an upper base 51 and a lower base 52, a chamber 53 provided in contact with the upper base 51, and most of the structure shown in FIG. 2 are housed in this chamber 53. The chamber 53 is connected to a vacuum evacuation unit and an atmospheric gas feeding unit not shown, and a raw metal powder (powder particles) 46 to be charged between the upper and the lower punches 42 and 43 can be held in a desired atmosphere such as an inert gas atmosphere. While an energizing unit is omitted in FIGS. 2 and 5, another energizing unit separately provided is connected to the upper and the lower punches 42 and 43 and the punch electrodes 44 and 45 so that pulse current as shown in FIG. 5 can be fed from this energizing unit via the punches 42 and 43 and the punch electrodes 44 and 45.

In order to manufacture a gear 1 from a glassy alloy by means of the spark plasma sintering machine having the above-mentioned configuration, a raw material powder for forming 46 should be prepared.

A manufacturing process of the raw material powder 46 comprises the step, for example, of preparing a single-element powder or single-element lumps for each of the components of the glassy alloy (may be partially alloyed in advance), mixing these single-element powder and single-element lumps, the melting the resultant mixed powder in an inert gas atmosphere such as Ar gas in a melting unit such as a crucible to obtain an alloy melt having a prescribed composition, forming a bulk-shaped, ribbon-shaped, linear or powdery shape by the casting, process of pouring the alloy melt into a mold and slowly cooling the same, by the quenching process of using a single roll or dual rolls, by the wet spinning process, by the solution extracting process, or by high-pressure gas spraying process, and the pulverizing the resultant product other than powder.

After preparation of the raw material powder 46 as described above, the subsequent steps comprise charging the powder into a forming mold 41 provided between the upper and the lower punches 42 and 43 of the spark plasma sintering machine, vacuum-evacuating the interior of the chamber 53, conducting forming by applying a pressure from above and below with the punches 42 and 43, impressing a pulse current as shown, for example, in FIG. 4 to the raw material powder 46 for heating and forming. In this spark plasma sintering, it is possible to heat the raw material powder 46 rapidly at a prescribed heating rate with the supplied current, and to strictly control temperature of the raw material powder 46 in response to the value of supplied current. It is therefore possible to perform temperature control far more accurately than in heating with a heater, thus permitting sintering under conditions close to ideal ones as preciously designed.

In the invention, a sintering temperature of at least 300° C. is required for ensuring solidification and forming of the raw material powder. Since the glassy alloy used as the raw material powder has a large value of temperature interval ΔTx(Tx−Tg) of the supercooled liquid, a high-density sinter is suitably available by conducting sintering under pressure by the utilization of viscous flow generated at a temperature within a range of from Tg to Tx.

Because of the special configuration of the spark plasma sintering machine, the monitored sintering temperature is the temperature of the thermocouple provided in the die, resulting in a temperature lower than that to which the powder sample is exposed.

Particularly, when Si is added to a metal-metalloid glassy alloy, there occurs an increase in the crystallization temperature, leading to a larger temperature interval ΔTx of the supercooled liquid. A thermally more stable amorphous material is therefore available. It is therefore possible to obtain a bulk-shaped sinter having a higher density as compared with the case using a raw material powder not containing Si, by pulverizing the glassy alloy, and conducting sintering under pressure.

In the invention, the heating rate for sintering should preferably be at least 10°/minute.

The pressure in sintering should preferably be at least 3 tons/cm$^2$ because a sinter cannot be formed under a lower pressure.

A heat treatment for annealing or partial crystallization may be applied to the resultant sinter. The heat treatment temperature in this case, when heat-treating a metal-metalloid glassy alloy, should preferably be within a range of from 300 to 500°, or more preferably, from 300 to 450° C. When heat-treating a metal-metal glassy alloy, temperature should preferably within a range of from 427° C. (700 K) to 627° C. (900 K), or more preferably, from 477° C. (750 K) to 523° C. (800 K).

When heat-treating another metal-metal glassy alloy added with a rare-earth element, temperature should preferably be within a range of from 500 to 850° C., ore more preferably, from 550 to 750° C.

Among the manufacturing conditions, a suitable cooling rate is determined, depending upon the alloy composition, means for manufacture thereof, the size of the product and the shape thereof.

In the manufacturing method of a gear of this embodiment, a gear 1 comprising a bulk-shaped sinter is available by filling a forming mold 41 having fine irregularities 41*a* with the powder (raw material powder) 46 of the above-mentioned glassy alloy, and sintering the powder 46 of the glassy alloy at a sintering temperature near the crystallization-temperature. The above-mentioned glassy alloy has a very broad temperature interval ΔTx of the supercooled liquid region, permits manufacture of a bulk-shaped sinter having a thickness sufficient to apply to a gear, and manufacture of a high-hardness sinter. The gear 1 comprising the sinter obtained by the foregoing method has the same chemical composition as the glassy alloy used as the raw material powder, exhibits a high hardness, and can have a further improved hardness through a heat treatment.

It is therefore possible to obtain a gear of a very high performance by manufacturing the same in accordance with the above-mentioned embodiment.

Figure 6:
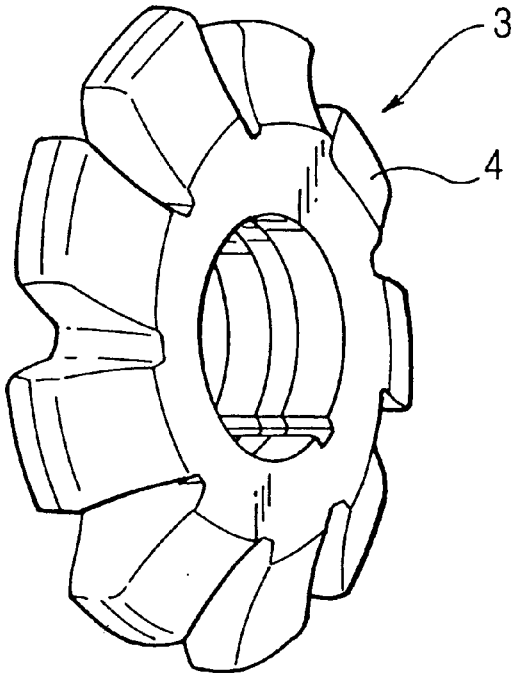
FIG. 6 is a perspective view illustrating an embodiment of the gear cutter of the invention.

FIG. 6 is a perspective view illustrating an embodiment of the gear cutter manufactured by the manufacturing method of a part having fine surface irregularities of the present invention.

This gear cutter 3 is manufactured by sintering the powder of the above-mentioned glassy alloy. The gear cutter 3 has a cutting edge (fine irregularities) on the outer periphery.

This gear cutter 3 can be manufactured in the same manner as in the above-mentioned manufacturing method of a gear except for the use of a forming mold having fine irregularities formed on the inner surface in response to the shape of the gear cutter, of the spark plasma sintering machine.

The gear cutter 3 thus obtained has the same composition as the glassy alloy used as the raw material powder, exhibits a high hardness, and can have a further improved hardness through a heat treatment. The cutting edge 4 of the gear cutter 3 should preferably be polished for finding.

Figure 7:
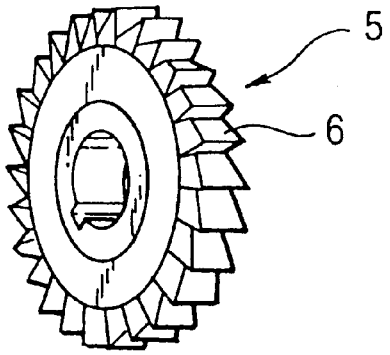
FIG. 7 is a perspective view illustrating an embodiment of the side milling cutter of the invention.

FIG. 7 is a perspective view illustrating an embodiment of a side milling cutter manufactured by the manufacturing method of a part having fine irregularities of the present invention.

This side milling cutter 5 is manufactured by sintering the powder of the above-mentioned glassy alloy. The side milling cutter 5 has a cutting edge (fine irregularities) on the outer periphery.

The side milling cutter 5 can be manufactured in the same manner as in the above-mentioned manufacturing method of a gear except for the use of a forming mold having fine irregularities formed on the inner surface in response to the shape of the side milling cutter, of the spark plasma sintering machine.

The side milling cutter 5 thus obtained has the same composition as the glassy alloy used as the raw material powder, exhibits a high hardness, and can have a further improved hardness through a heat treatment. The cutting edge 6 of the side milling cutter 5 should preferably be polished for finishing.

In the above-mentioned embodiment, the case of manufacturing the bulk-shaped sinter comprising the glassy alloy from the powder of the glassy alloy by the spark plasma sintering process has been described. The manufacturing method is not limited to this, but a bulk-shaped sinter can be obtained also by sintering the raw material powder by a method such as the extruding process.

Because the material exhibits a remarkable viscous flow within a range of from Tg to Tx, the product can be formed by clog-forging by the heating it to a temperature within a range of from Tg to Tx.

Embodiments of application of the sinter of the present invention to a golf club and golf club shaft will now be described in detail.

Figure 8:
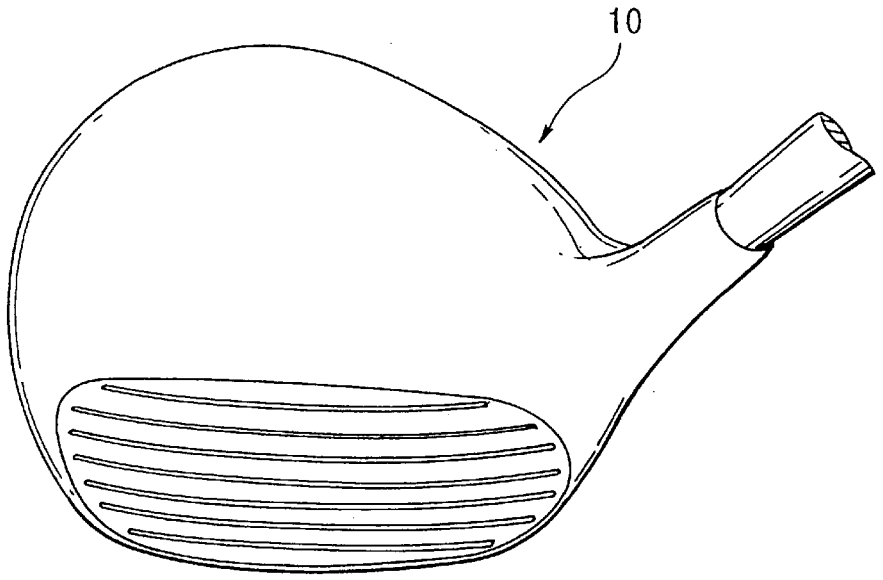
FIG. 8 is a perspective view illustrating a first embodiment of the golf clubhead which is an embodiment of the invention.

FIG. 8 a perspective view illustrating a first embodiment of the golf club head of the invention. In this wood-type golf club head 10, the entire head is composed of a high-hardness glassy alloy. This gives an improved bounce sufficient to ensure a longer yardage. Even when the sole portion rubs the ground upon swinging, the head is hardly damaged. Since even contact with other club or the like does not easily cause flaws, a good exterior view can be kept for a longer period of time.

Figure 9:
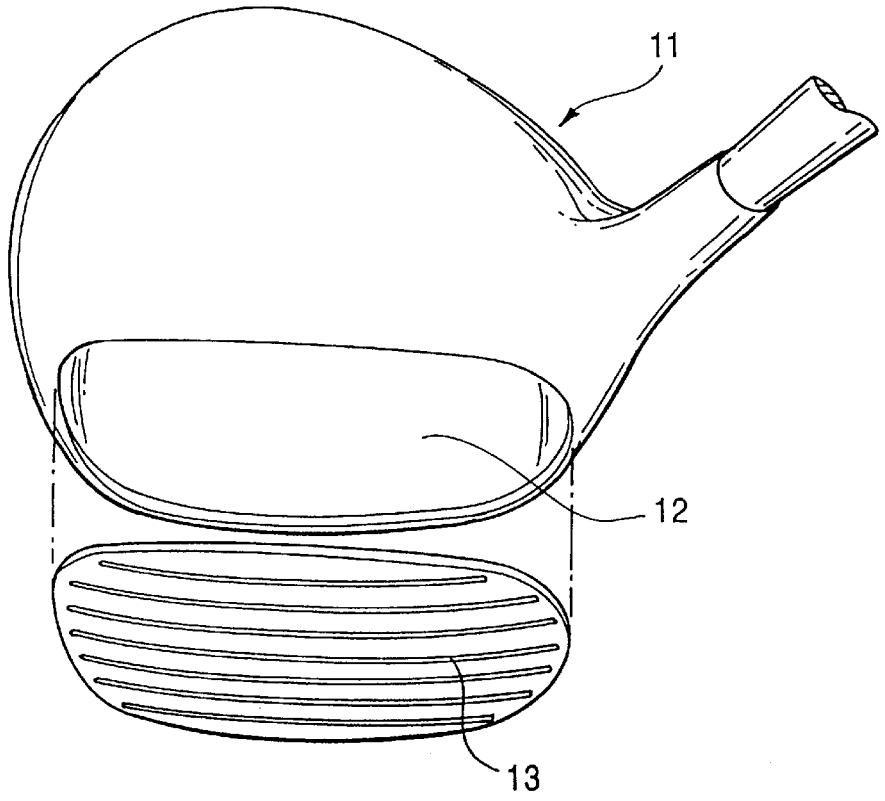
FIG. 9 is an exploded view illustrating a second embodiment of the golf clubhead which is an embodiment of the invention.

The glassy alloy may be used only for a part of the golf clubhead of the invention. FIG. 9 is an exploded view illustrating a second embodiment of the golf clubhead of the invention. This embodiment has a configuration in which a face portion 13 is fitted to, and fixed to, an opening 12 provided in the wood-type golf clubhead main body 11. A golf clubhead of the invention is available by making this wood-type golf clubhead main body 11 with a conventional material such as stainless steel, and making only the face portion 13 with a glassy alloy.

By adopting this configuration, it suffices to compose only the face portion with the glassy alloy. It is thus easier to fabricate the head and possible to provide the head at a lower cost.

Figure 10:
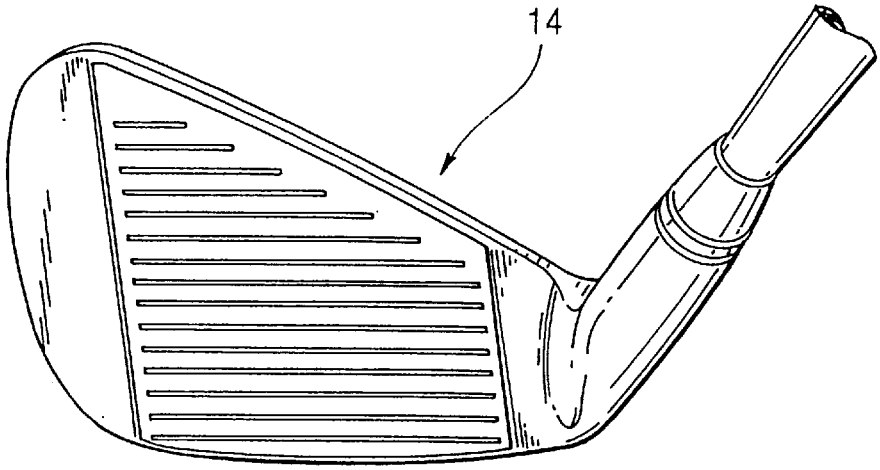
FIG. 10 is a front view illustrating a third embodiment of the golf clubhead which is an embodiment of the invention.

FIG. 10 is a perspective view illustrating a third embodiment of the golf clubhead of the invention. In this iron-type golf clubhead 14, the entire head is made of the above-mentioned glassy alloy. In this iron-type golf clubhead 14, the entire head is composed of a high-hardness glassy alloy. This gives an improved bounce sufficient to ensure a longer yardage. Even when the sole portion rubs the ground upon swinging, the head is hardly damaged. Since even contact with the other club or the like does not easily cause flaws, a good exterior view can be kept for a longer period of time.

Figure 11:
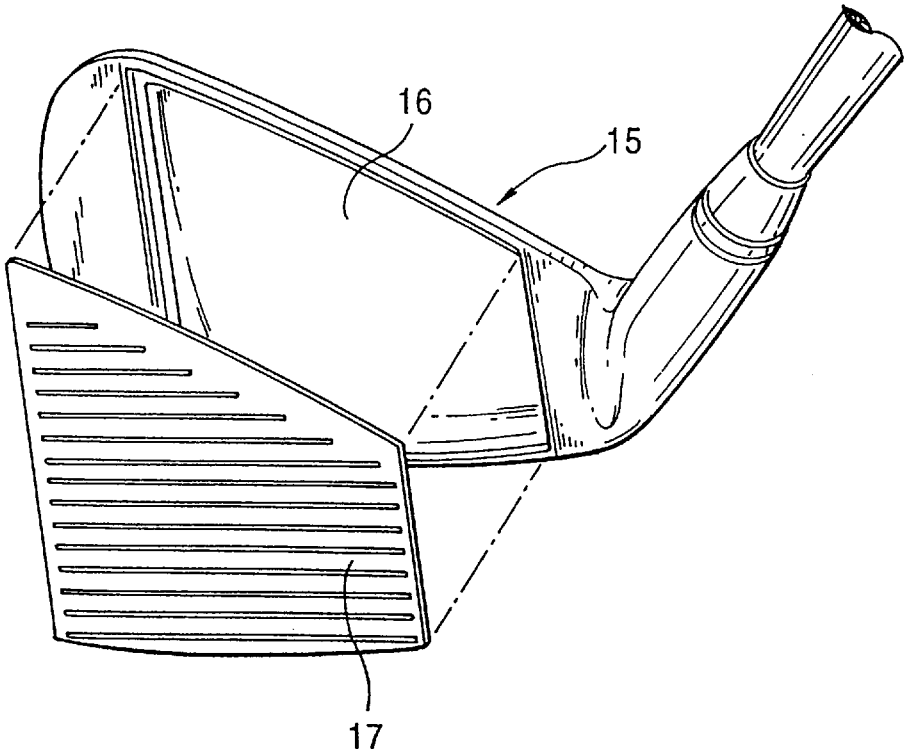
FIG. 11 is an exploded view illustrating a fourth embodiment of the golf clubhead which is an embodiment of the invention.

The glassy alloy may be used only for a part of the golf clubhead of the invention. FIG. 11 is an exploded view illustrating a fourth embodiment of the golf clubhead of the invention. This embodiment has a configuration in which a face portion 17 is fitted to, and fixed to, an opening 16 provided in the iron-type golf clubhead main body 15. A golf clubhead of the invention is available by making this iron-type golf clubhead main body 15 with a conventional material such as stainless steel, and making only the face portion 17 with a glassy alloy.

By adopting this configuration, it suffices to compose only the face portion with the glassy alloy. It is thus easier to fabricate the head and possible to provide the head at a lower cost.

Figure 12:
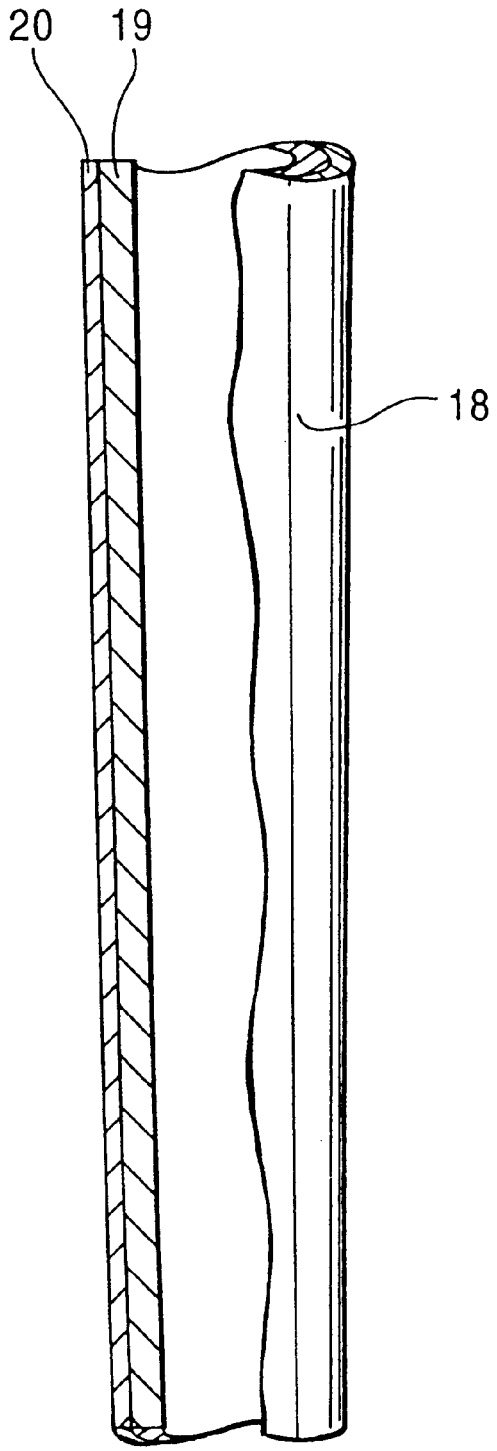
FIG. 12 is a partial sectional view illustrating of the golf club shaft which is an embodiment of the invention.

FIG. 12 is a partial sectional view illustrating an embodiment of the golf club shaft of the invention. This golf club shaft 18 comprises an inner layer 19 formed into a tubular shape by impregnating carbon fiber groups aligned in a direction with a thermosetting synthetic resin, and an outer layer 20 formed by impregnating fine line or filament-shaped alloy groups aligned in a direction with a thermosetting synthetic resin. Shaft strength can be improved by composing the fine line or filament-shaped alloy groups with a high-hardness glassy alloy, and further, because strength is not improved by increasing fine line thickness, an increase in the shaft weight is inhibited.

In order to manufacture the golf clubhead of the invention, it is necessary to manufacture a sheet-shaped glassy alloy. A method of manufacturing a sheet-shaped glassy alloy is the spark plasma sintering process described above.

The glassy alloy used for the above-mentioned gear, gear cutter, golf clubhead, and golf club shaft can be used by sintering by the foregoing spark plasma sintering process, or in the form of a casting formed by the casting process by means of a casting mold. An embodiment of such as application will now be described with reference to the drawings.

Figure 13:
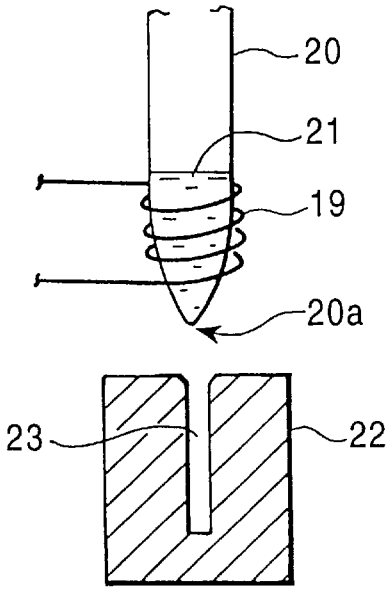
FIG. 13 is a schematic view illustrating a typical casting machine used for manufacturing the casting of the invention.

FIG. 13 illustrates a typical casting machine used for casting. In FIG. 13, the casting machine substantially comprises a crucible 20 and a mold 22. The crucible 20 has a high frequency coil 19 for heating arranged around the same, and heats and melts a glassy alloy composition received therein by feeding current to the high frequency coil 19. An ejecting hole 20*a* is formed at the lower end of the crucible 20, and a mold 22 made of copper or the like is arranged thereunder. The mold 22 has a cylindrical casting cavity 23 formed therein.

Though not shown, an inert gas feeding device above the crucible 20 is connected thereto. The inert gas feeding device can maintain an inert gas atmosphere in the crucible 20, and as required, permits pouring the melt 21 of the composition through the ejecting hole 20*a* of the crucible 20 into the casting cavity 23 of the mold 22 by increasing inner pressure of the crucible 20.

Figure 14:
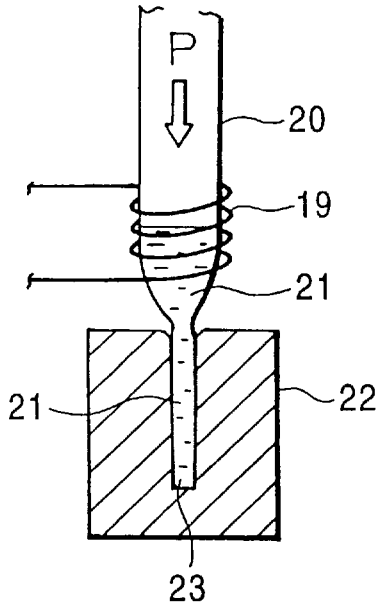
FIG. 14 is a schematic view illustrating a pattern of use of the casting machine shown in FIG. 13.

In order to obtain a solid form of the glassy alloy by the use of the machine shown in FIG. 13, the melt is ejected through the ejecting hole 20*a* of the crucible 20 and cast into the casting cavity 23 of the mold 22 by applying a prescribed pressure P with an inert gas into the interior of the crucible 20 as shown in FIG. 14, and the poured melt is cooled. A solid composition of the glassy alloy can thus be obtained.

Thus obtained solid composition after removal from the mold may be used as it is, or used after annealing or at least partial crystallization by heat-treating at a temperature within a range of from 500 to 850° C. and then cooling the heat-treated composition.

Figure 15:
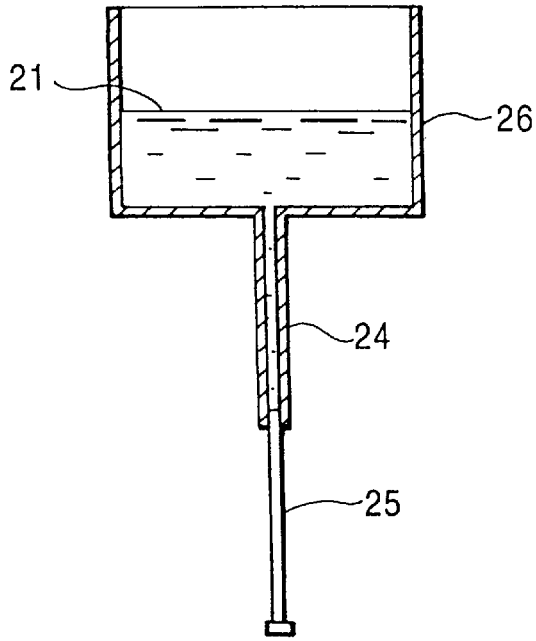
FIG. 15 a schematic view illustrating another typical casting machine.

In the above-mentioned case, the casting machine provided with the crucible 20 and the mold 22 has been described. For example, a casting machine as shown in FIG. 15 may be used, which has a crucible-type melting vessel 26 provided with a cylinder 24 and a piston 25 serving as a crucible and a mold on the bottom, and in which the melt 21 is introduced into the cylinder 24 by pulling down the piston 25 for cooling. It is needless to mention that casting machines of various other configurations are also applicable.

EXAMPLES

The present invention will now be described in detail by means of examples and comparative example.

Example 1

An ingot having an atomic component ratio of $Fe_{73}A_{15}Ga_2P_{11}C_5B_4$ was prepared by weighing Fe, Al and Ga, an Fe—C alloy, an Fe—P alloy and B as raw materials in prescribed amounts, respectively, and melting these raw materials in an Ar atmosphere under a reduced pressure in a high frequency induction heater. The thus prepared ingot was melted in a crucible, and a quenched thin strip comprising an amorphous single-phase-structure having a thickness of from 35 to 135 $\mu$m was obtained in an Ar atmosphere under a reduced pressure by the single roll process of quenching the melt by spraying the same form a nozzle of the crucible onto a rotating roll. The thus obtained quenched thin strip was analyzed by differential scanning calorimeter (DSC) measurement: the result suggested that $\Delta Tx$ was within a very broad range as at least 46.9° C.

The quenched thin strip was pulverized by crushing the same in the open air by means of a rotor mill. Particles having particle sizes within a range of from 53 to 105 $\mu$m were selected for the resultant powder particles, and used as the raw material powder for subsequent steps.

The above-mentioned raw material powder in an amount of about 2 g was charged into a die made by WC by means of a hard press, and then charged into a forming mold 41 shown in FIG. 2. The interior of the chamber was pressed with the upper and the lower punches 42 and 43 in an atmosphere under a pressure of $3\times10^{-5}$ torr, and pulse waves were fed from the current feeding unit to the raw material powder for heating.

Figure 4:
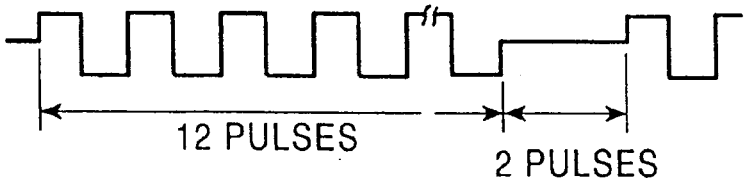
FIG. 4 is a diagram illustrating an example of pulse current waveform impressed on a raw material powder in the spark plasma sintering machine shown in FIG. 2.

The pulse waveform comprised stoppage for two pulses after 12 pulses as shown in FIG. 4, and the raw material powder was heated with current of up to 4,700 to 4,800 A.

Sintering was carried out by heating the sample from the room temperature to the sintering temperature under a pressure of 6.5 tons/cm$^2$ applied on the sample, and holding for about five minutes. The heating rate was 100° C./min.

Figure 16:
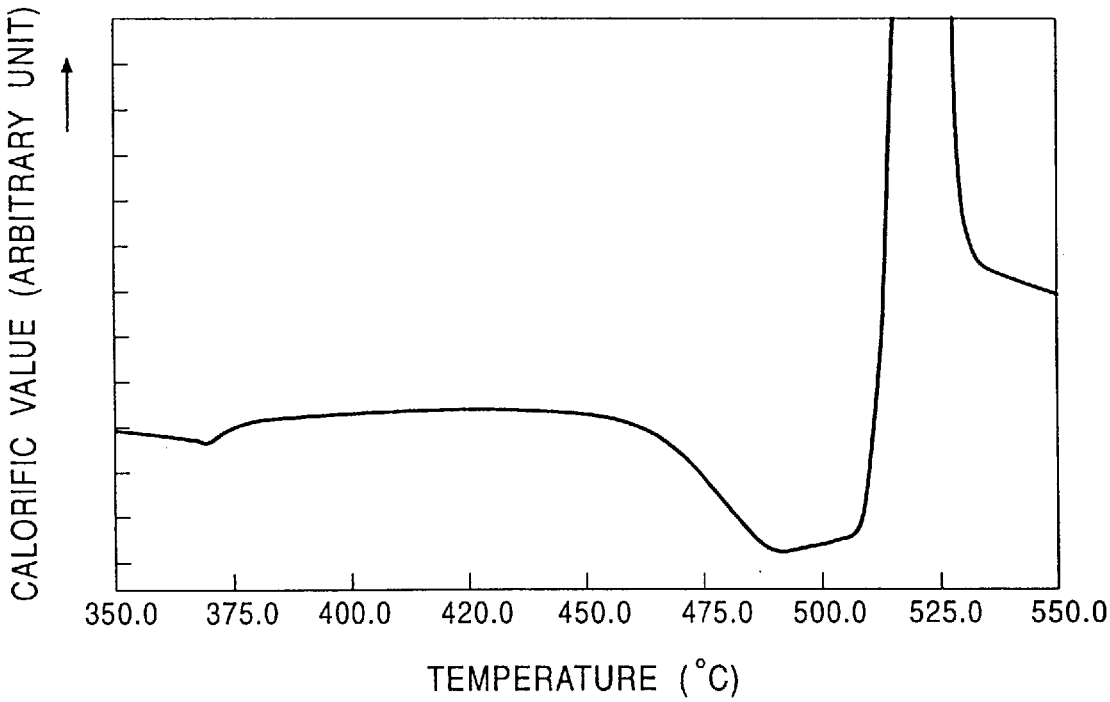
FIG. 16 is a graph illustrating a DSC curve of a raw material powder in an example.
Figure 17:
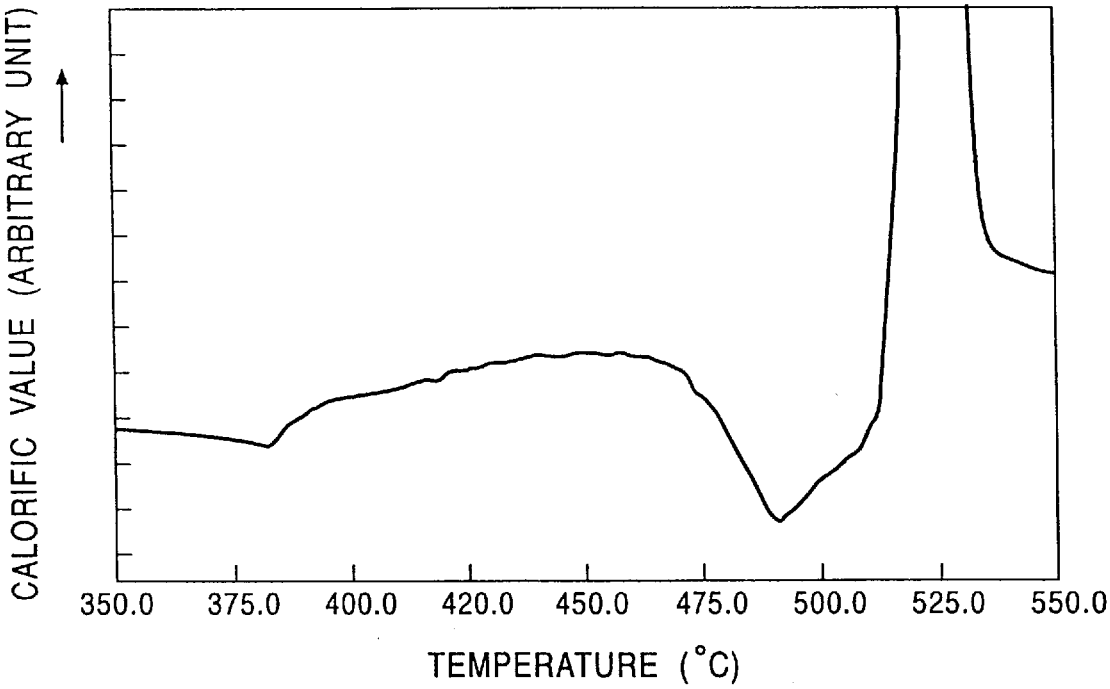
FIG. 17 is a graph illustrating a DSC curve of a sinter in an example.

FIG. 16 illustrates a DSC (a curve based on measurement by a differential scanning calorimeter) for a raw material powder obtained by pulverizing a quenched non-crystalline alloy thin strip having a composition $Fe_{73}A_{15}Ga_2P_{11}C_5B_4$; and FIG. 17 illustrates a DSC curve for a sinter obtained by spark-plasma-sintering the aforesaid powder at a sintering temperature of 430° C.

Figure 18:
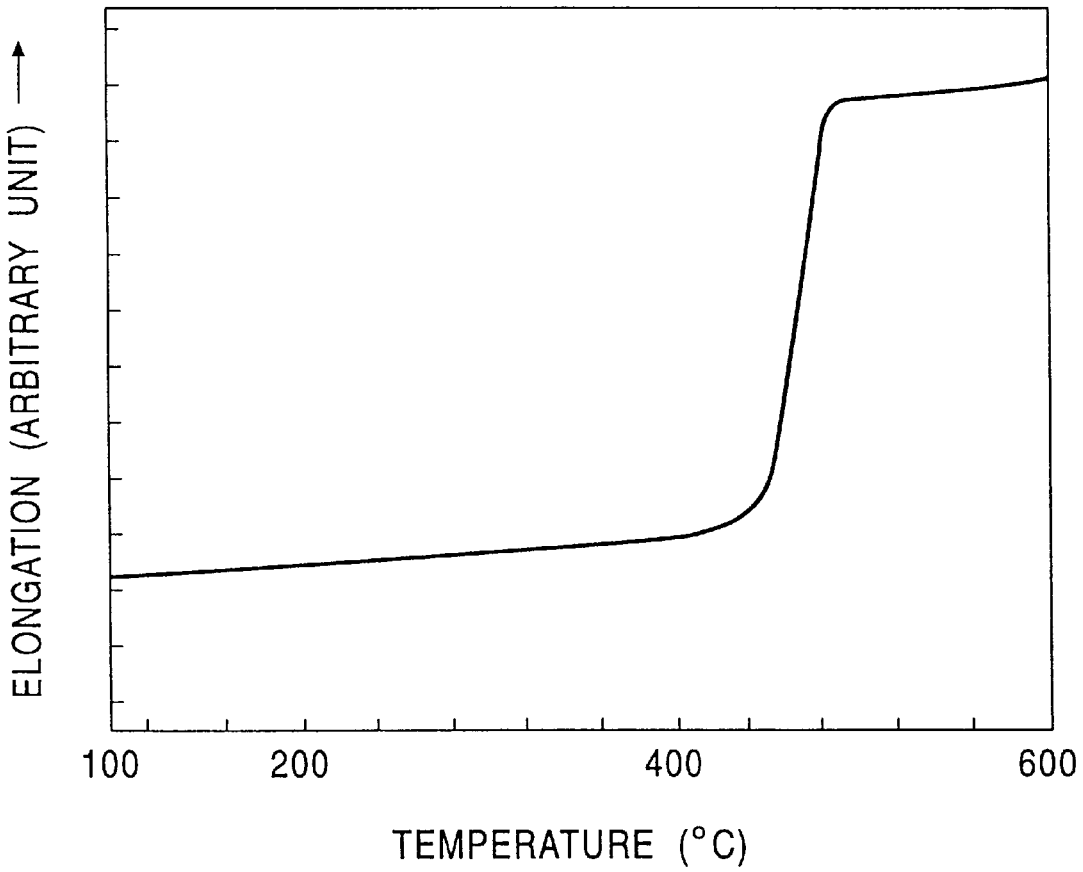
FIG. 18 is a graph illustrating a TMA curve of a quenched non-crystalline alloy thin strip in an example.

FIG. 18 illustrates a TMA (thermomechanical analysis curve) for a quenched non-crystalline alloy thin strip before pulverization.

From the DSC curve shown in FIG. 16, Tx=512° C., Tg=465° C. and $\Delta Tx$=47° C. for the raw material powder are derived. A supercooled liquid region is existent over a wide temperature region of up to the crystallization temperature, with a large value of $\Delta Tx=Tx-Tg$, thus suggesting a high amorphous phase forming ability of the alloy of this composition.

From the DSC curve shown in FIG. 17, Tx=512° C., Tg=465° C. and ΔTx=47° C. for the sinter are determined. The results shown in FIGS. 16 and 17, Tx, Tg and ΔTx are the same between the non-crystalline alloy pulverized powder and the sinter.

Further, the TMA (thermomechanical analysis) curve shown in FIG. 18 reveals that the sample is sharply elongated with the increase in temperature within a temperature region of from 440 to 480° C. This suggests that softening of the alloy occurs in the supercooled liquid temperature region. Solidification and forming by the utilization of this softening phenomenon of the non-crystalline alloy are favorable for increasing density.

Figure 19:
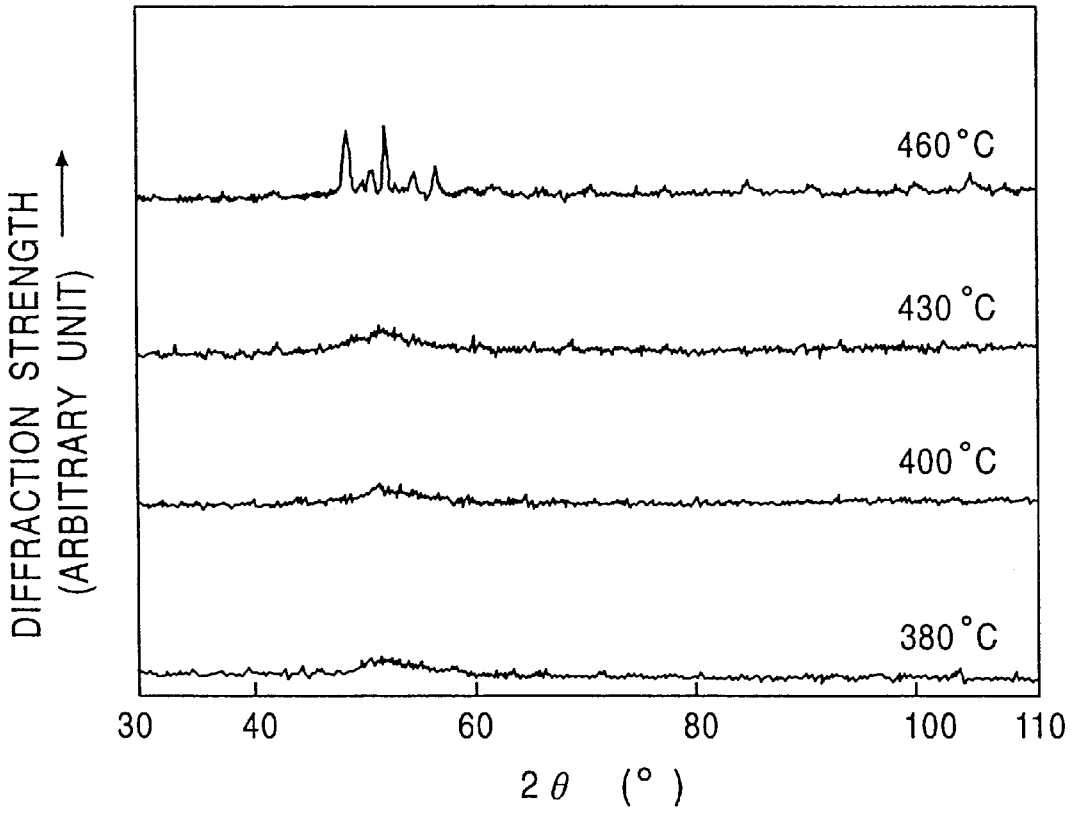
FIG. 19 is a graph illustrating an X-ray diffraction figure of a sinter obtained by sintering at a temperature of 380 to 460° C. in an example.

FIG. 19 illustrates the results of an X-ray diffraction analysis of a sinter in an as-sintered state when the raw material powder is spark-plasma-sintered at sintering temperatures 380° C., 400° C., 430° C. and 460° C., respectively. In the samples sintered at 380° C., 400° C. and 430° C., the results demonstrate harrowed patterns, suggesting the presence of an amorphous single phase structure. In the sample sintered at 460° C., on the other hand, the diffraction curve shows sharp peaks suggesting the presence of a crystalline phase.

Figure 20:
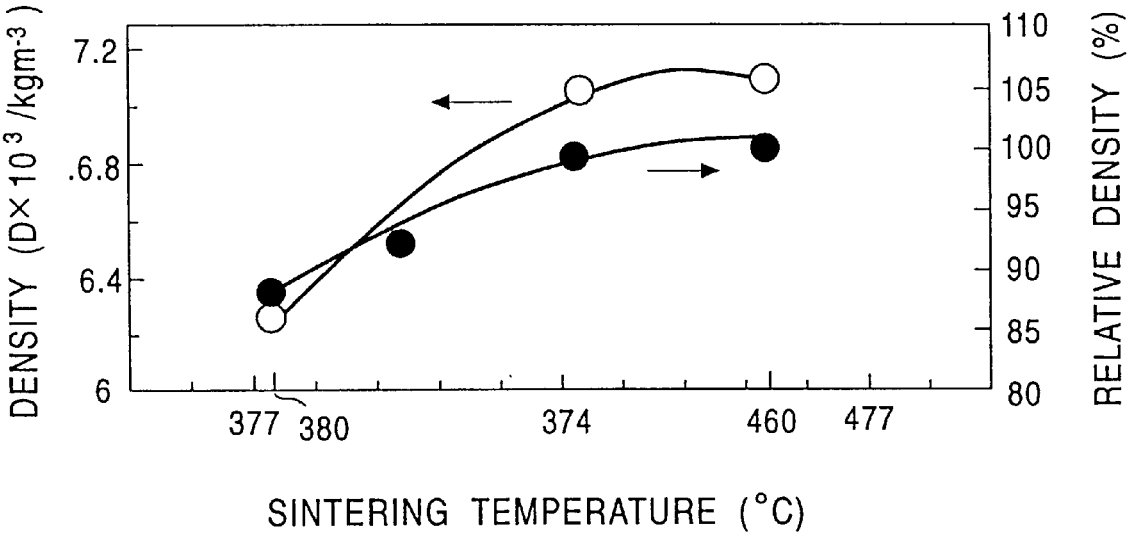
FIG. 20 is a graph illustrating sintering temperature dependency of sinter density obtained in an example.

FIG. 20 illustrates the sintering temperatures in cases of sintering by the spark plasma sintering process, and the resultant densities of the sinters.

As shown in FIG. 20, density of the sinter increases with the increase in the sintering temperature, and a sinter having a high density as represented by a relative density of at least 99.7% is obtained by sintering at a sintering temperature of at least 430° C. By increasing the pressure during sintering, it is possible to obtain a high density sinter even at a lower temperature.

These results suggest that, when preparing a formed product by the use of a glassy alloy having a composition $Fe_{73}A_{15}Ga_2P_{11}C_5B_4$, it is possible to obtain a product having an amorphous single-phase structure in as-sintered state with a high density by selecting a sintering temperature of up to 430° C. (in other words, when the crystallization temperature is Tx and the sintering temperature is T1, within a range T1≦Tx).

For a sinter sample resulting from sintering of a glassy alloy powder having a composition Fe73A15Ga2P11C5B4 by the spark plasma sintering process, Vichers hardness was measured: a result of 1,250 Hv was shown, suggesting the possibility to provide a very hard product. Sintering in this case was accomplished by heating the powder under a pressure of 6.5 tons/cm$^2$ from the room temperature to the sintering temperature of 430° C. at a heating rate of 100° C./min.

Example 2

Single pure metals Fe, Co, Ni and Zr and pure boron crystal were mixed in an Ar gas atmosphere and arc-melted to manufacture a base alloy.

Then, the resultant base alloy was melted in a crucible, and was quenched by ejecting the melt, by the application of the single roll process, through a nozzle having a diameter of 0.4 mm at the lower end of the crucible onto a copper roll rotating at 40 m/s in an argon gas atmosphere, thus manufacturing a sample of the glassy alloy having a width of from 0.4 to 1 mm and a thickness of from 13 to 32 μm. The resultant sample was analyzed by differential scanning calorimeter (DSC) measurement.

Figure 21:
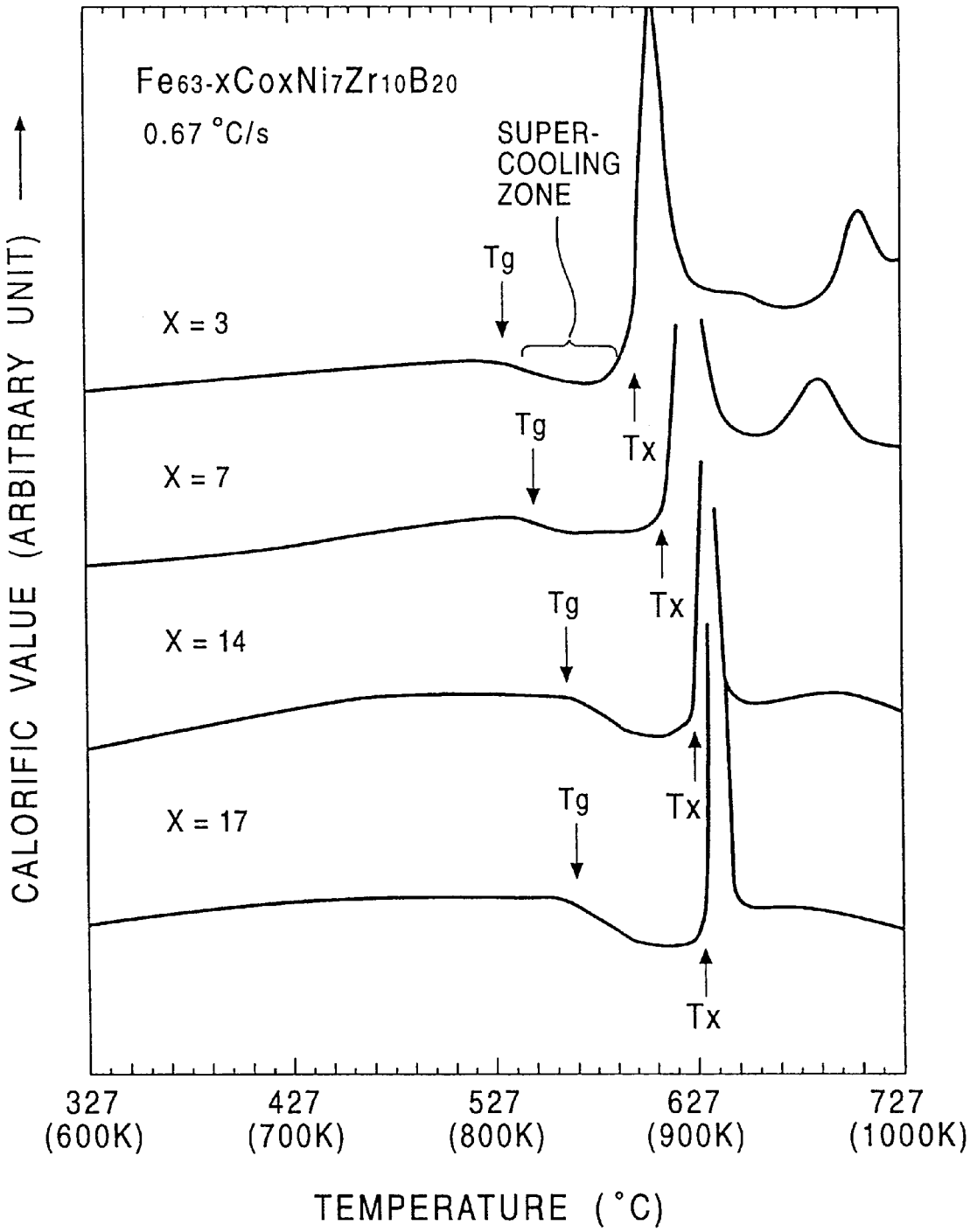
FIG. 21 is a graph illustrating DSC curves of glassy alloy thin strips having compositions $Fe_{60}Co_3Ni_7Zr_{10}B_{20}$, $Fe_{56}Co_7Ni_7Zr_{10}B_{20}$, $Fe_{49}Co_{14}Ni_7Zr_{10}B_{20}$, and $Fe_{46}Co_{17}Ni_7Zr_{10}B_{20}$, respectively.

FIG. 21 illustrates DSC curves of glassy alloy samples having compositions $Fe_{60}Co_3Ni_7Zr_{10}B_{20}$, $Fe_{56}Co_7Ni_7Zr_{10}B_{20}$, $Fe_{49}Co_{14}Ni_7Zr_{10}B_{20}$, and $Fe_{46}Co_{17}Ni_7Zr_{10}B_{20}$, respectively.

In any of these samples, these was confirmed the presence of a broad supercooled liquid region by increasing temperature, and heating beyond the supercooled liquid region led to crystallization. The temperature interval ΔTx of the supercooled liquid region is expressed by ΔTx=Tx−Tg. For all the samples shown in FIG. 21, the value of Tx−Tg is over 60° C. and is within a range of from 64 to 68° C. A substantial equilibrium state showing the supercooled liquid region was obtained within a wide range of from 596° C. (869 K) slightly lower than the crystallization temperature resulting from calorific peaks to 632° C. (905 K).

Figure 22:
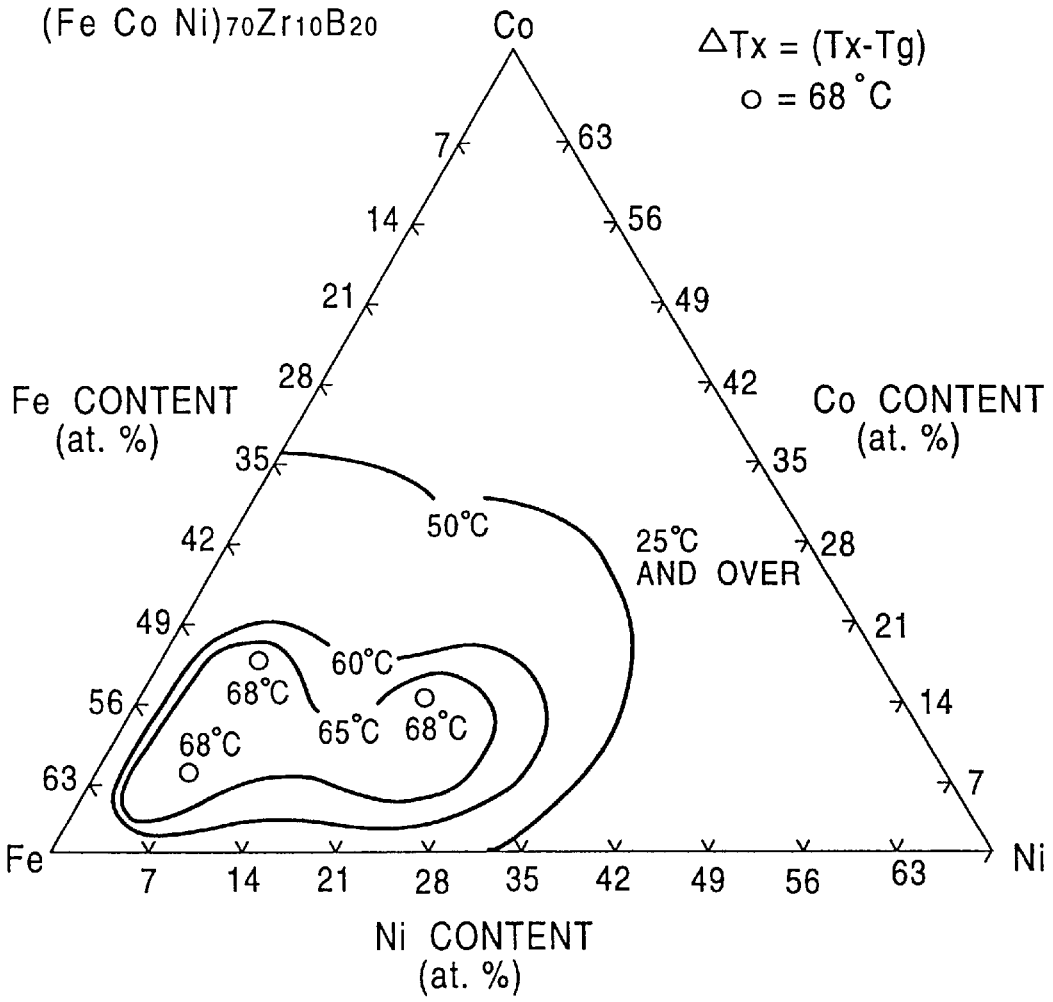
FIG. 22 is a constitutional diagram illustrating dependency of Fe, Co, and Ni contents on the value of ΔTx(=Tx−Tg) in a composition $(Fe_{1-a-b}Co_aNi_b)_{70}Zr_{10}B_{20}$.

FIG. 22 is a triangular constitutional diagram representing the dependency of ΔTx (=Tx−Tg) on the contents of Fe, Co and Ni, respectively, in a composition $(Fe_{1-a-b}Co_aNi_b)_{70}Zr_{10}B_{20}$.

As is clear from the result shown in FIG. 22, the value of ΔTx is over 25° C. in all the range of the composition $(Fe_{1-a-b}Co_aNi_b)_{70}Zr_{10}B_{20}$. It was suggested that the value of ΔTx is larger in a composition containing much Fe. In order to achieve a value of ΔTx of at least 60° C., it is desirable to select a Co content within a range of from 3 to 20 atomic %, and an Ni content within a range of from 3 to 30 atomic %.

In a composition $(Fe_{1-a-b}Co_aNi_b)_{70}Zr_{10}B_{20}$, a Co content of at least 3 atomic % leads to $(Fe_{1-a-b}Co_aNi_b)$ of 70 atomic %, resulting in a Co component ratio a of at least 0.042. A co content of at least 20 atomic % requires a Co component ratio a of up to 0.29. Similarly, in order to achieve an Ni content of at least 3 atomic %, the Ni component ratio b should be at least 0.042, and in order to achieve an Ni content of up to 30 atomic %, the Ni component ratio b must be up to 0.43.

Example 3

An example regarding a glassy alloy formed by adding Nb to the composition of Example 2 will now be described.

Single pure metals Fe, Co, Ni, Zr and Nb and pure boron crystal are mixed in an Ar gas atmosphere and arc-melted to prepare a base alloy.

Then, the resultant base alloy was melted in a crucible, and ribbons (thin strips) of various thicknesses were obtained by applying the single roll process of quenching the melt by ejecting the same from a nozzle bore at the lower end of the crucible onto a copper roll in an argon gas atmosphere. In this example, a ribbon (thin strip) having a thickness of from 20 to 195 μm was obtained by adopting a copper roll rotating speed of from 2.6 to 41.9 m/s, a nozzle bore diameter of from 0.4 to 0.7 mm, an injection pressure of the base alloy melt of from 0.32 to 0.42 kgs/cm$^2$, and gap between the nozzle and the copper roll of from 0.3 to 0.45 mm.

Figure 23:
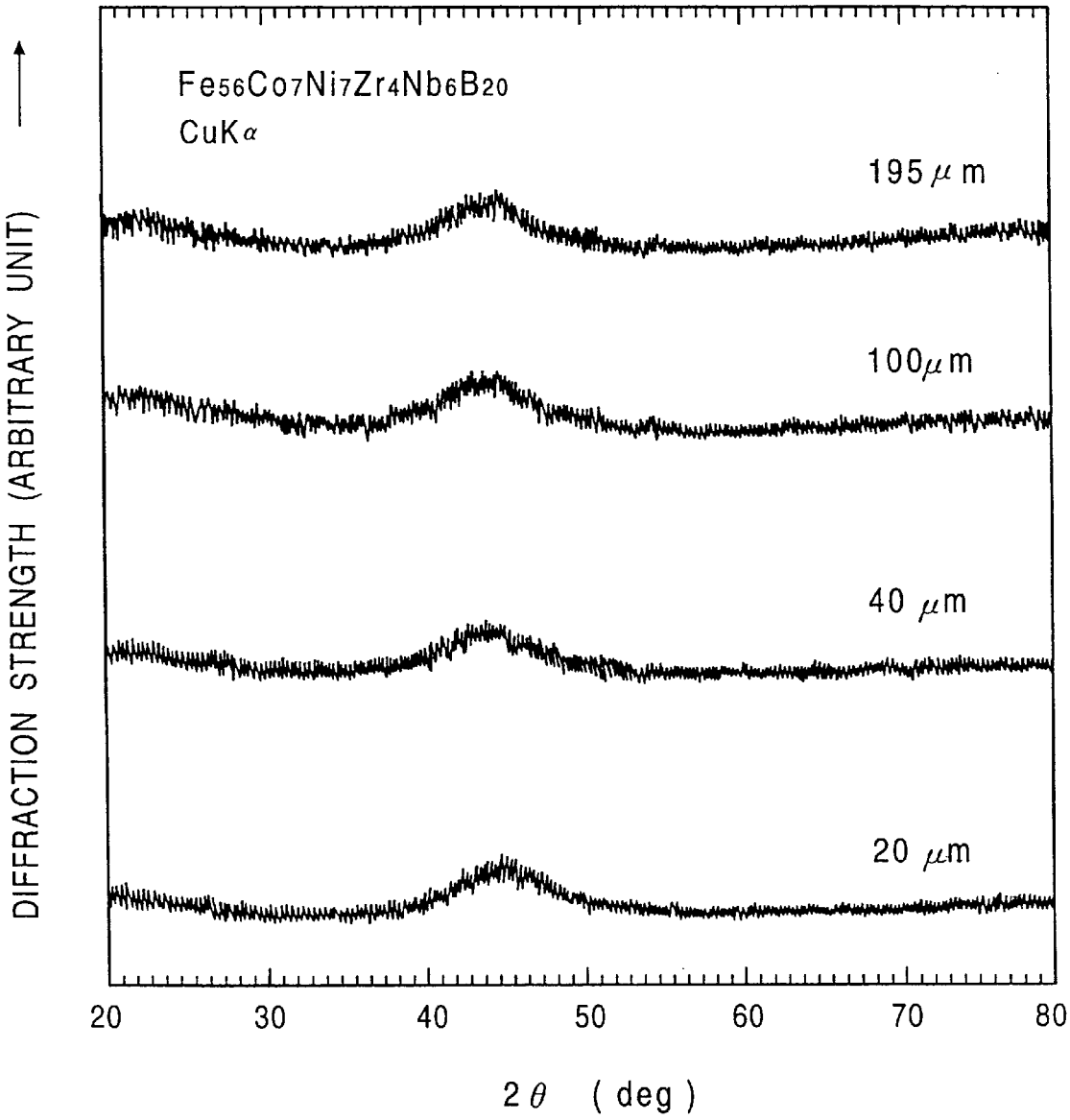
FIG. 23 is a graph illustrating an X-ray diffraction pattern in a thin strip sample having a composition $Fe_{56}Co_7Ni_7Zr_4Nb_6B_{20}$ of a thickness of 20 to 195 μm.

FIG. 23 illustrates X-ray diffraction patterns of thin strip samples having a composition $Fe_{56}Co_7Ni_7Zr_4Nb_6B_{20}$ obtained as above. The X-ray diffraction patterns shown in FIG. 23 reveals that all the sample having a thickness within the range of from 20 to 195 μm have harrowed patterns at 2θ=40 to 50 (deg), thus suggesting the presence of an amorphous single phase structure.

These results suggest that, according to this example, a ribbon of an amorphous single phase structure having a thickness of from 20 to 195 μm is obtained by the application of the single roll process.

Figure 24:
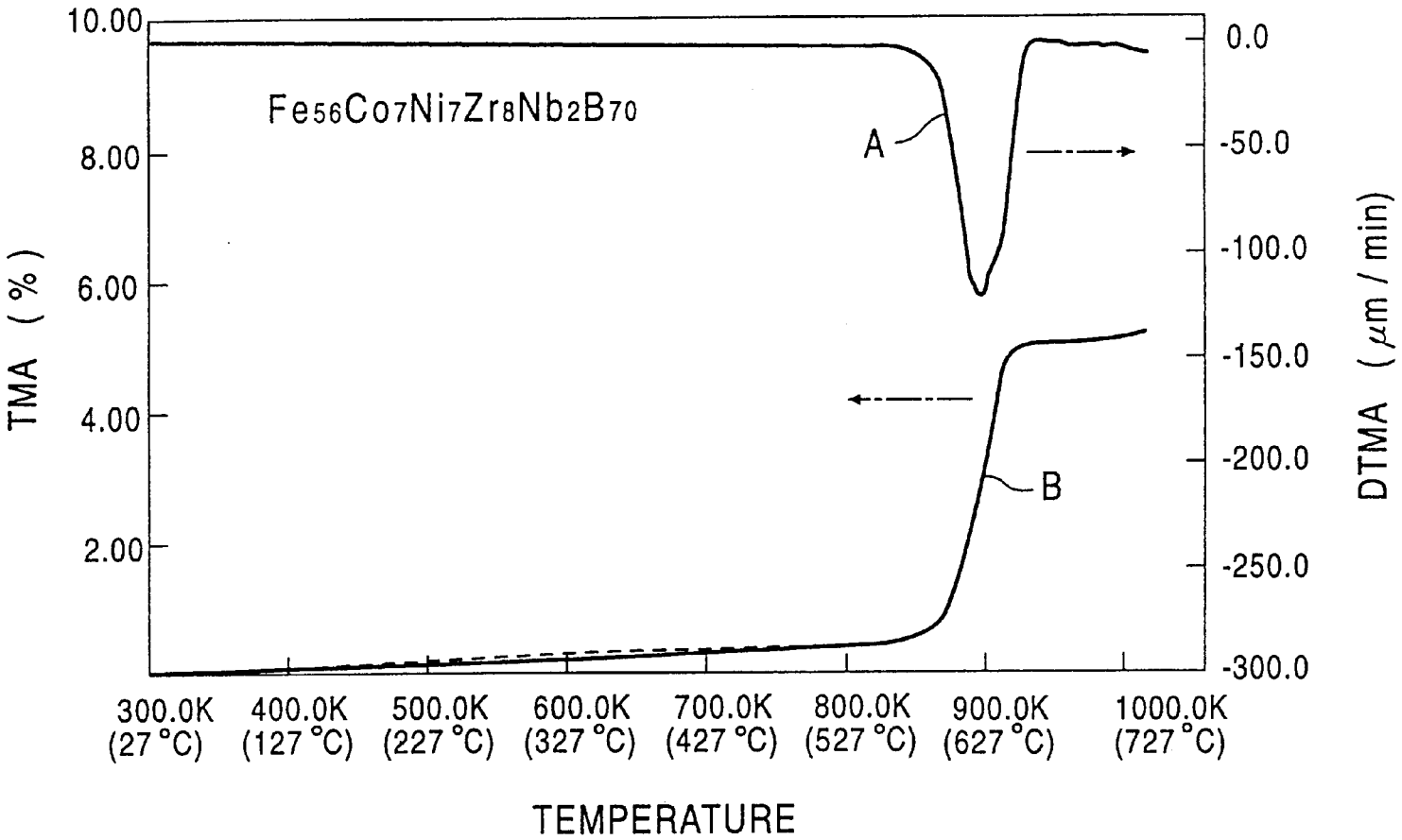
FIG. 24 is a graph illustrating a TMA curve and a DTMA curve of a thin strip of a composition $Fe_{56}Co_7Ni_7Zr_8Nb_2B_{20}$.

FIG. 24 illustrates a TMA (thermomechanical analysis) curve and a DTMA (differential thermomechanical analysis)

curve for a thin strip sample having a composition $Fe_{56}Co_7Ni_7Zr_8Nb_2B_{20}$. In FIG. 24, the curve (A) is a TMA curve and the curve (B) is a DTMA curve.

The DTMA curve shown in FIG. 24 demonstrates that the absolute differential value is large near 612.7 (° C.) and the sample tends to elongate near 612.7 (° C.). The TMA curve reveals that the sample suddenly elongates along with the increase in temperature within a temperature range of from 577 to 647 (° C.). This suggests that a viscous flow occurs in the supercooled liquid temperature region. Solidification and forming by the utilization of the softening phenomenon of a non-crystalline alloy are favorable for achieving a higher density. cl Example 4

A glassy alloy thin strip sample manufactured in the same manner as in the above-mentioned Examples 1 to 3 was pulverized in the open air by means of a rotor mill into powder. From among the resultant powder particles, those having particle sizes within a range of from 53 to 105 μm were selected and used as a raw material powder for the subsequent steps.

The above-mentioned powder in an amount of about 2 g was charged into a die made of WC (tungsten carbide) by the use of a hand press, and then charged into a forming mold 41 shown in FIG. 2. The interior of the chamber was pressed by the upper and the lower punches 42 and 43 in an atmosphere of $3\times10^{-5}$ torr, and a bulk-shaped sinter was obtained by sintering the raw material powder by feeding pulse waves from the energizing unit. The pulse waveform comprised a stoppage for two pulses after flow of 12 pulses as shown in FIG. 4, and the raw material powder was heated with current of up to 4,700 to 4,800 A. Sintering in this case was accomplished by heating the raw material powder under a pressure of 6.5 tons/cm$^2$ from the room temperature to the sintering temperature, and then holding for five minutes. The heating rate in sintering was 100° C./minute.

The glass transition temperature (Tg), crystallization temperature (Tx), temperature range (ΔTx) of the supercooled liquid region, Vickers hardness (Hv) and compression strength (σc, f) were measured for the resultant bulk-shaped sinter. Vickers hardness was measured, for a glassy alloy of each composition, by preparing a pin-shaped sample having a diameter of from 1 to 10 mm and a length of from 50 to 100 mm, and applying a load of 500 g by means of a Vickers micro-hardness meter. Compression strength was measured, for a glassy alloy of each composition, by preparing a sample having a diameter of 2.5 mm and a length of 60 mm, and using a compression strength meter (Model 4204 made by Instron Co., Ltd.). The results are shown in Table 1.

TABLE 1

| Alloy composition | Tg ° C. | Tx ° C. | ΔTx ° C. | Hv | σc, f MPa |
|---|---|---|---|---|---|
| $Fe_{61}Co_7Ni_7Zr_{10}B_{15}$ | 522 | 587 | 65 | 1310 | 3400 |
| $Fe_{58}Co_7Ni_7Zr_{10}B_{18}$ | 529 | 600 | 71 | 1340 | 3500 |
| $Fe_{56}Co_7Ni_7Zr_{10}B_{20}$ | 541 | 614 | 73 | 1370 | 3600 |
| $Fe_{56}Co_7Ni_7Zr_8Nb_2B_{20}$ | 555 | 641 | 86 | 1370 | 3600 |
| $Fe_{56}Co_7Ni_7Zr_8Ta_2B_{20}$ | 554 | 642 | 88 | 1360 | 3600 |
| $Fe_{61}Co_7Ni_7Zr_8Nb_2B_{15}$ | 535 | 590 | 64 | 1360 | 3500 |
| $Fe_{61}Co_7Zr_{10}Mo_5W_2B_{15}$ | 625 | 689 | 50 | 1340 | 3800 |
| $Fe_{72}Al_5Ga_2P_{10}C_6B_4Si_1$ | 490 | 541 | 51 | 1250 | — |
| $Fe_{63}Co_7Nd_6Zr_4B_{20}$ | 560 | 607 | 47 | 1320 | — |

As is clear from the results shown in Table 1, the glassy alloy samples within the range of composition of the invention gave a Vickers hardness within a range of from 1,250 to 1,370, and a very large value of compression strength within a range of from 3,400 to 3,800 MPa.

Example 5

Single pure metals such as Fe, Co, Nd, and Cr or Zr and pure boron crystal were mixed in an argon gas atmosphere and arc-melted to manufacture a base alloy.

Then, the resultant base alloy was melted in a crucible, and a glassy alloy thin strip sample having an amorphous single phase structure was prepared by applying the single roll process of quenching the melt by spraying the same under an injection pressure of 0.50 kgf/cm$^2$ from a nozzle having a diameter of from 0.35 to 0.45 mm provided at the lower end of the crucible onto a copper roll rotating at a speed of 4,00 rpm in an argon gas atmosphere of 60 cmHg. The single roll of the single roll liquid quenching unit used in this case had a surface finished by #1500. The gap between the single roll and the nozzle tip was 0.30 mm.

The resultant glassy alloy thin strip sample was pulverized into powder by crushing in the open air by the use of a rotor mill. From among the resultant powder particles, those having particles sizes within a range of from 53 to 105 μm were selected and used as a raw material powder in the subsequent steps.

The above-mentioned powder in an amount of about 2 g was charged into a die made of WC (tungsten carbide) by the use of a hand press, and then charged into a forming mold 41 shown in FIG. 2. The interior of the chamber was pressed by the upper and the lower punches 42 and 43 in an atmosphere of $3\times10^{-5}$ torr, and a sinter was obtained by sintering the raw material powder by feeding pulse waves from the energizing unit. The pulse waveform comprised a stoppage for two pulses after flow of 12 pulses as shown in FIG. 4, and the raw material powder was heated with current of up to 4,700 to 4,800 A. Sintering in this case was accomplished by heating the raw material powder under a pressure of 6.5 tons/cm$^2$ from the room temperature to the sintering temperature, and then holding for five minutes. The heating rate in sintering was 40° C./min (0.67 K/sec).

The sample thus obtained was analyzed by X-ray diffraction and differential scanning calorimeter (DSC).

Figure 25:
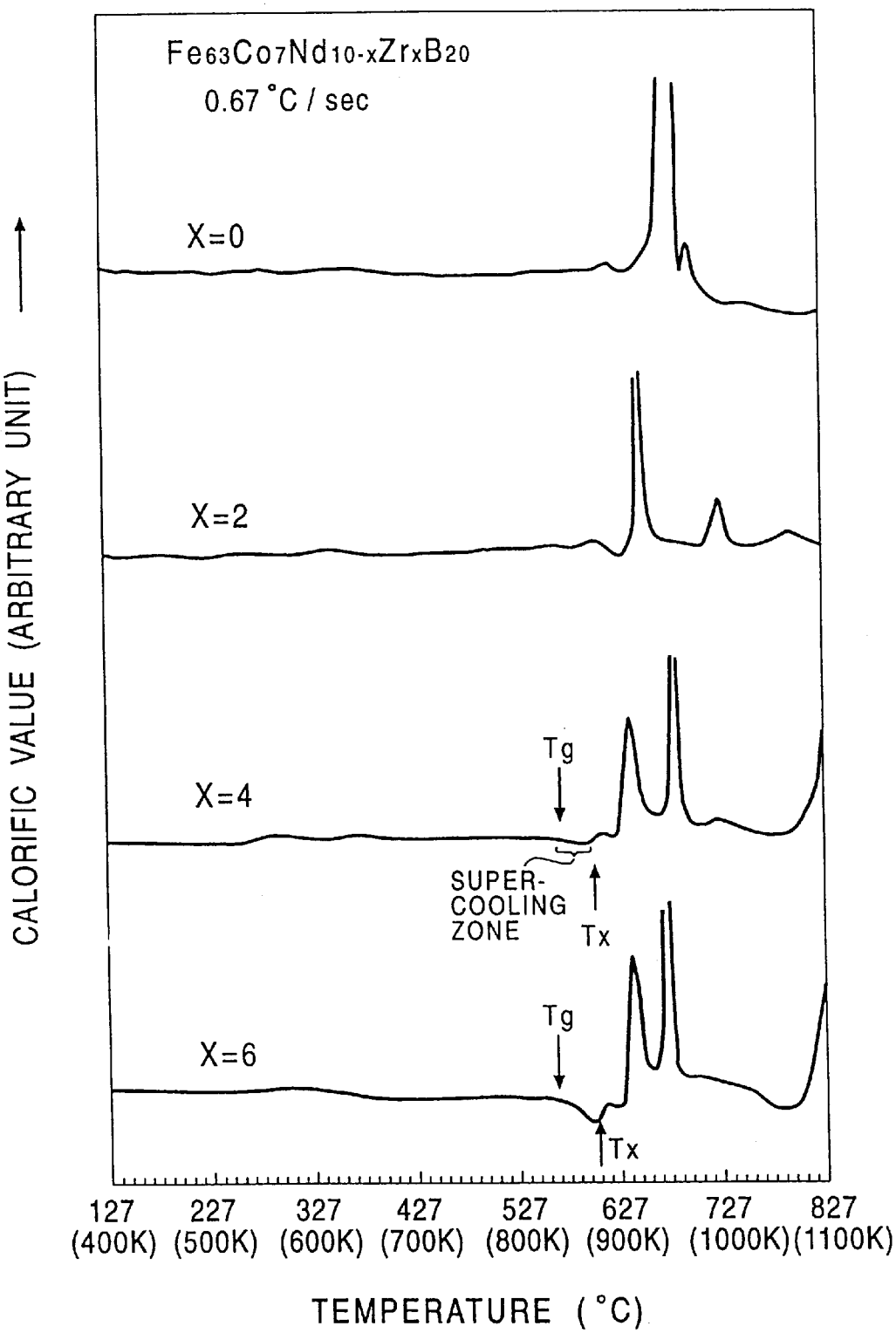
FIG. 25 is graph illustrating the results of determination of a DSC curve of a thin strip sample of a composition $Fe_{63}Co_7Nb_{10-1}Zr_xB_{20}$ (X=0, 2, 4, or 6 atomic %) as quenched, manufactured by the single roll process.

FIG. 25 illustrates the results of determination of a DSC curve in the case where thin strip samples having compositions $Fe_{63}Co_7Nd_{10-x}Zr_xB_{20}$ (x=0, 2, 4 and 6 atomic %) were heated within a range of from 127 to 827° C. at a heating rate of 0.67° C./sec.

From FIG. 25, in the case of a glassy alloy thin strip sample having a composition $Fe_{63}Co_7Nd_{10}B_{20}$, more than three heat peaks are observed, and crystallization is considered to occur in more than three stages. While the glass transition temperature Tg is not observed at temperatures under the crystallization temperature Tx, addition of Zr and increasing the amount of addition permit observation of an endothermic reaction considered to correspond to Tg at temperatures under Tx with the amount of added Zr of at least 4 atomic %.

Figure 26:
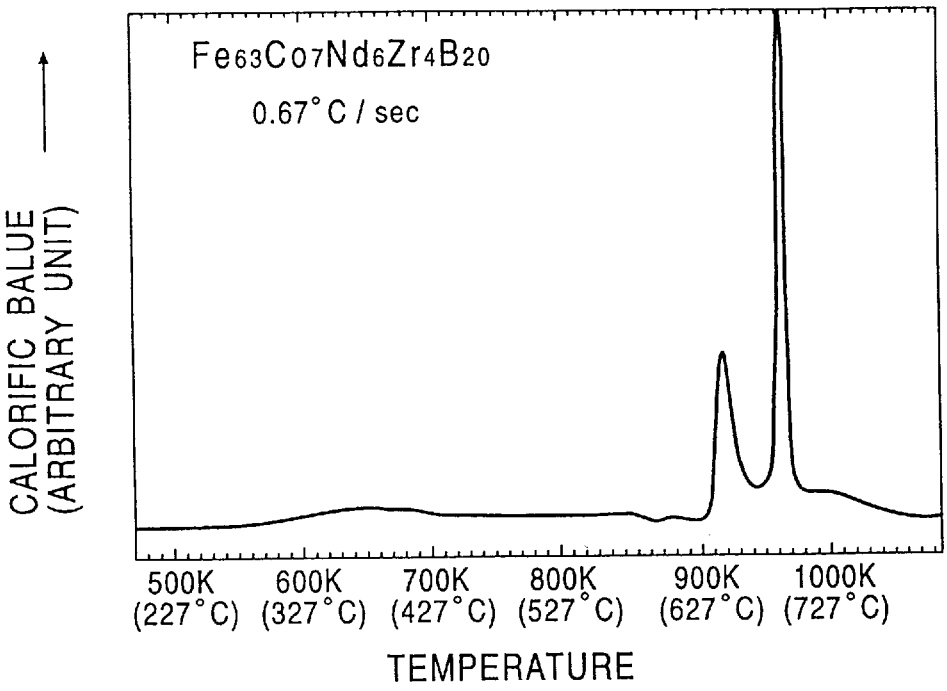
FIG. 26 is a graph illustrating a DSC curve of a glassy alloy thin strip sample of a composition $Fe_{63}Co_7Nb_5Zr_4B_{20}$.
Figure 27:
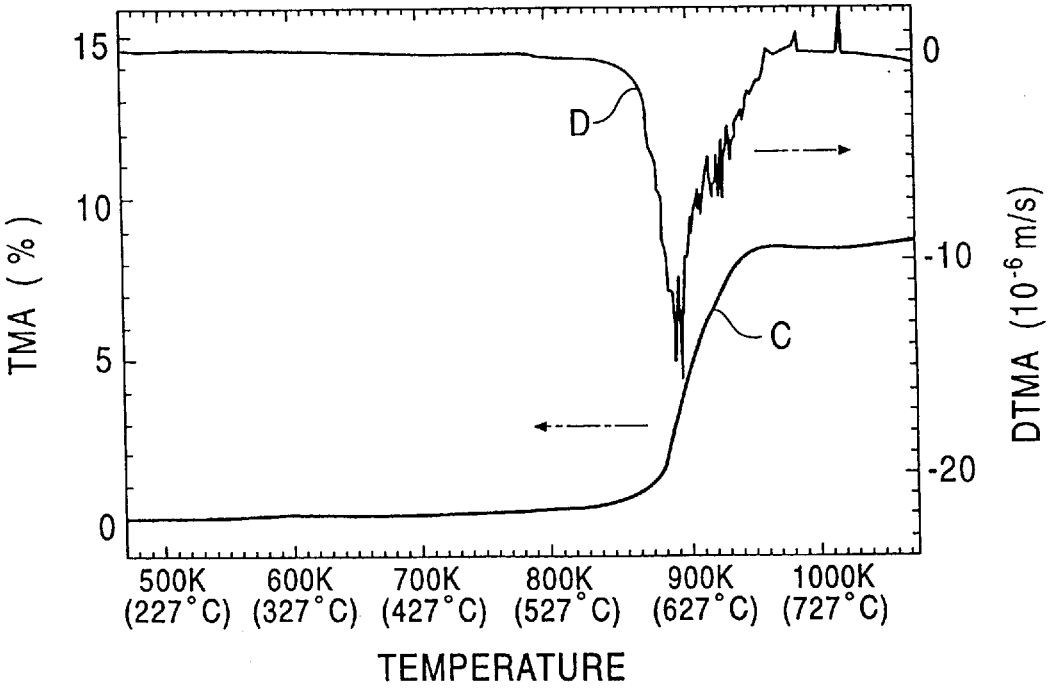
FIG. 27 is a graph illustrating a TMA curve and a DTMA curve of a glassy alloy thin strip sample of a composition $Fe_{63}Co_7Nb_6Zr_4B_{20}$.

Then, the relationship between the heating temperature (° C.) and the calorific value for a glassy alloy thin strip sample having a composition $Fe_{63}Co_7Nd_6Zr_4B_{20}$ was investigated. The result is shown in FIG. 26. FIG. 26 illustrates a DSC curve for a glassy alloy thin strip sample having a composition $Fe_{63}Co_6Zr_4B_{20}$. The relationship between the heating temperature (° C.) and elongation for a glassy alloy thin strip sample having a composition $Fe_{63}Co_7Nd_6Zr_4B_{20}$ was investigated. The results are shown in FIG. 27. In FIG. 27, the curve (C) is a TMA curve for the glassy alloy thin strip sample of a composition $Fe_{63}Co_7Nd_6Zr_4B_{20}$, and the curve (D) is a DTMA curve thereof.

As is clear from FIGS. 26 and 27, for the DSC curve, heat peaks are observed near 647° C. and 687° C. (920 K and 960 K). Because there is observed a large absolute differential value near 627° C. (900 K) for the DTMA curve, the sample tends to elongate near 627° C. (900 K), and the TMA curve suggests that the sample shows a sharp elongation along with the increase in temperature in the temperature region of from 577 to 677° C. (from 850 to 950 K). This means that a viscous flow occurs in the supercooled liquid temperature region. Solidification and forming by the utilization of softening phenomenon of the non-crystalline alloy are favorable for achieving a higher density.

The present invention is not limited by the above-mentioned examples in any manner, and it is needless to mention that various embodiments are possible in terms of composition, manufacturing method, heat treatment conditions and shape.

What is claimed is:

1. A casting comprising a high-hardness glassy alloy containing at least Fe and at least a metalloid element and having a temperature interval ΔTx of a supercooled liquid as expressed by ΔTx=Tx−Tg (where, Tx is a crystallization temperature and Tg is a glass transition temperature) of at least 20° C.;

wherein said glassy alloy comprises at least one element selected from the group consisting of Fe, Co and Ni and contains at least one selected from the group consisting of Zr, Nb, Ta, Hf, Mo, Ti and V.

2. A casting comprising a high-hardness glassy alloy according to claim 1, wherein said glassy alloy has a value of ΔTx of at least 60 tC, and is expressed by the following chemical formula:

$$(Fe_{1-a-b}Co_aNi_b)_{100-x-y}M_xB_y$$

where, 0≦a≦0.29, 0≦b≦0.43, 5 atomic %≦x≦20 atomic %, 10 atomic %≦y≦22 atomic %, and M is at least one element selected from the group consisting of Zr, Nb, Ta, Hf, Mo, Ti and V.

3. A casting comprising a high-hardness glassy alloy according to claim 1, wherein said glassy alloy has a value of ΔTx of at least 60° C., and is expressed by the following chemical formula:

$$(Fe_{1-a-b}Co_aNi_b)_{100-x-y-z}M_xB_yT_z$$

where, 0≦a≦0.29, 0≦b≦0.43, 5 atomic %≦x≦20 atomic %, 10 atomic %≦y≦22 atomic %, 0 atomic %≦z≦5 atomic %, M is at least one element selected from the group consisting of Zr, Nb, Ta, Hf, Mo, Ti and V, and T is at least one element selected from the group consisting of Cr, W, Ru, Rh, Pd, Os, Ir, Pt, Al, Si, Ge, C and P.

4. A casting comprising a high-hardness glassy alloy according to claim 1 wherein said glassy alloy comprises at least two elements selected from the group consisting of Fe, Co and Ni and contains at least one selected from the group consisting of Zr, Nb, Ta, Hf, Mo, Ti and V.

5. A casting comprising a high-hardness glassy alloy according to claim 4, wherein said glassy alloy has a value of ΔTx of at least 60° C., and is expressed by the following chemical formula:

$$(Fe_{l-a-b}Co_aNi_b)_{100-x-y}M_xB_y$$

where, 0≦a≦0.29, 0≦b≦0.43, 5 atomic %≦x≦20 atomic %, 10 atomic %≦y≦22 atomic %, and M is at least one element selected from the group consisting of Zr, Nb, Ta, Hf, Mo, Ti and V.

6. A casting comprising a high-hardness glassy alloy according to claim 4, wherein said glassy alloy has a value of ΔTx of at least 60° C., and is expressed by the following chemical formula:

$$(Fe_{l-a-b}Co_aNi_b)_{100-x-y-z}M_xB_yT_z$$

where, 0≦a≦0.29, 0≦b≦0.43,5 atomic % ≦x≦20 atomic %, 10 atomic %≦y≦22 atomic %, 0 atomic %≦z≦5 atomic %, M is at least one element selected from the group consisting of Zr, Nb, Ta, Hf, Mo, Ti and V, and T is at least one element selected from the group consisting of Cr, W, Ru, Rh, Pd, Os, Ir, Pt, Al, Si, Ge, C and P.

7. A casting comprising a high-hardness glassy alloy according to claim 1, wherein said glassy alloy mainly comprises at least one element selected from the group consisting of Fe, Co and Ni and contains at least two selected from the group consisting of Zr, Nb, Ta, Hf, Mo, Ti and V.

8. A casting comprising a high-hardness glassy alloy according to claim 7, wherein said glassy alloy has a value of ΔTx of at least 60° C., and is expressed by the following chemical formula:

$$(Fe_{l-a-b}Co_aNi_b)_{100-x-y}M_xB_y$$

where, 0≦a≦0.29, 0≦b≦0.43, 5 atomic %≦x≦20 atomic %, 10 atomic %≦y≦22 atomic %, and M is at least one element selected from the group consisting of Zr, Nb, Ta, Hf, Mo, Ti and V.

9. A casting comprising a high-hardness glassy alloy according to claim 7, wherein said glassy alloy has a value of ΔTx of at least 60° C., and is expressed by the following chemical formula:

$$(Fe_{1-a-b}Co_aNi_b)_{100-x-y-z}M_xB_yT_z$$

where, 0≦a≦0.29, 0≦b≦0.43, 5 atomic %≦x≦20 atomic %, 10 atomic %≦y≦22 atomic %, 0 atomic %≦z≦5 atomic %, M is at least one element selected from the group consisting of Zr, Nb, Ta, Hf, Mo, Ti and V, and T is at least one element selected from the group consisting of Cr, W, Ru, Rh, Pd, Os, Ir, Pt, Al, Si, Ge, C and P.

10. A casting comprising a high-hardness glassy alloy according to claim 1, wherein said glassy alloy mainly comprises at least two elements selected from the group consisting of Fe, Co and Ni and contains at least two selected from the group consisting of Zr, Nb, Ta, Hf, Mo, Ti and V.

11. A casting comprising a high-hardness glassy alloy according to claim 10, wherein said glassy alloy has a value of ΔTx of at least 60° C., and is expressed by the following chemical formula:

$$(Fe_{1-a-b}Co_aNi_b)_{100-x-y}M_xB_y$$

where, 0≦a≦0.29, 0≦b≦0.43,5 atomic %≦x≦20 atomic %, 10 atomic %≦y≦22 atomic %, and M is at least one element selected from the group consisting of Zr, Nb, Ta, Hf, Mo, Ti and V.

12. A casting comprising a high-hardness glassy alloy according to claim 10, wherein said glassy alloy has a value of ΔTx of at least 60° C., and is expressed by the following chemical formula:

$$(Fe_{1-a-b}Co_aNi_b)_{100-x-y-z}M_xB_yT_z$$

where, 0≦a≦0.29, 0≦b≦0.43, 5 atomic %≦x≦20 atomic %, 10 atomic %≦y≦22 atomic %, 0 atomic %≦z≦5 atomic %, M is at least one element selected from the group consisting of Zr, Nb, Ta, Hf, Mo, Ti and V, and T is at least one element selected from the group consisting of Cr, W, Ru, Rh, Pd, Os, Ir, Pt, Al, Si, Ge, C and P.

* * * * *